US010269358B2

(12) United States Patent
Lecomte et al.

(10) Patent No.: US 10,269,358 B2
(45) **Date of Patent: *Apr. 23, 2019**

(54) AUDIO DECODER AND METHOD FOR PROVIDING A DECODED AUDIO INFORMATION USING AN ERROR CONCEALMENT BASED ON A TIME DOMAIN EXCITATION SIGNAL

(71) Applicant: Fraunhofer-Gesellschaft zur Foerderung der angewandten Forschung e.V., Munich (DE)

(72) Inventors: Jérémie Lecomte, Fuerth (DE); Goran Markovic, Nuremberg (DE); Michael Schnabel, Geroldsgruen (DE); Grzegorz Pietrzyk, Nuremberg (DE)

(73) Assignee: Fraunhofer-Gesellschaft zur Foerderung der angewandten Forschung, e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/261,341

(22) Filed: Sep. 9, 2016

(65) Prior Publication Data

US 2016/0379649 A1 Dec. 29, 2016

Related U.S. Application Data

(63) Continuation of application No. 15/142,547, filed on Apr. 29, 2016, which is a continuation of application No. PCT/EP2014/073035, filed on Oct. 27, 2014.

(30) Foreign Application Priority Data

Oct. 31, 2013 (EP) ..... 13191133
Jul. 28, 2014 (EP) ..... 14178824

(51) Int. Cl.
*G10L 19/005* (2013.01)
*G10L 19/02* (2013.01)
(Continued)

(52) U.S. Cl.
CPC ..... *G10L 19/005* (2013.01); *G10L 19/02* (2013.01); *G10L 19/09* (2013.01); *G10L 19/125* (2013.01);
(Continued)

(58) Field of Classification Search
CPC ..... G10L 19/005
(Continued)

(56) References Cited

U.S. PATENT DOCUMENTS 5,615,298 A 3/1997 Chen
5,909,663 A 6/1999 Iijima et al.
(Continued)

FOREIGN PATENT DOCUMENTS

CN 101231849 7/2008
CN 101399040 4/2009
(Continued)

OTHER PUBLICATIONS

3GPP TS 26.290: "Audio Codec Processing Functions: Extended Adaptive Multi-Rate-Wideband (AMR-WB+) codec; Transcoding Functions", Sep. 2009.
(Continued)

*Primary Examiner* — Susan I McFadden
(74) *Attorney, Agent, or Firm* — Dicke, Billig & Czaja, PLLC

(57) ABSTRACT

An audio decoder for providing a decoded audio information on the basis of an encoded audio information includes an error concealment configured to provide an error concealment audio information for concealing a loss of an audio
(Continued)

frame following an audio frame encoded in a frequency domain representation using a time domain excitation signal.

32 Claims, 12 Drawing Sheets

(51) Int. Cl.
*G10L 19/09* (2013.01)
*G10L 19/125* (2013.01)
*G10L 19/08* (2013.01)
*G10L 19/00* (2013.01)

(52) U.S. Cl.
CPC ..... *G10L 19/08* (2013.01); *G10L 2019/0011* (2013.01)

(58) Field of Classification Search
USPC ..... 704/500
See application file for complete search history.

(56) References Cited

U.S. PATENT DOCUMENTS

| | | | |
|---|---|---|---|
| 6,188,980 | B1 | 2/2001 | Thyssen |
| 6,418,408 | B1 | 7/2002 | Udaya Bhaskar et al. |
| 6,493,664 | B1 | 12/2002 | Udaya Bhaskar et al. |
| 6,629,283 | B1 | 9/2003 | Toyama |
| 6,757,654 | B1 | 6/2004 | Westerlund |
| 7,003,448 | B1 | 2/2006 | Lauber et al. |
| 7,308,406 | B2 | 12/2007 | Chen |
| 7,447,639 | B2 | 11/2008 | Wang |
| 7,693,710 | B2 | 4/2010 | Jelinek et al. |
| 7,933,769 | B2 | 4/2011 | Bessette |
| 8,000,960 | B2 | 8/2011 | Chen et al. |
| 8,184,809 | B2 | 5/2012 | Lecomte |
| 8,219,393 | B2 | 7/2012 | Oh |
| 8,255,207 | B2 | 8/2012 | Vaillancourt et al. |
| 8,457,115 | B2 | 6/2013 | Zhan et al. |
| 8,515,767 | B2 | 8/2013 | Reznik |
| 8,527,265 | B2 | 9/2013 | Reznik |
| 8,706,479 | B2 | 4/2014 | Zopf |
| 8,725,501 | B2 | 5/2014 | Ehara |
| 8,731,910 | B2 | 5/2014 | Wu et al. |
| 8,798,172 | B2 | 8/2014 | Oh et al. |
| 8,983,851 | B2 | 3/2015 | Rettelbach et al. |
| 9,008,306 | B2 | 4/2015 | Lecomte |
| 9,043,215 | B2 | 5/2015 | Neuendorf |
| 9,076,439 | B2 | 7/2015 | Zopf |
| 9,384,739 | B2 | 7/2016 | Lecomte |
| 9,406,307 | B2 | 8/2016 | Rose |
| 9,460,723 | B2 | 10/2016 | Friedrich |
| 9,830,920 | B2 | 11/2017 | Rose |
| 2002/0002412 | A1 | 1/2002 | Gunji et al. |
| 2004/0128128 | A1 | 7/2004 | Wang et al. |
| 2004/0250195 | A1 | 12/2004 | Toriumi |
| 2005/0143985 | A1 | 6/2005 | Sung et al. |
| 2006/0206318 | A1 | 9/2006 | Kapoor et al. |
| 2007/0067166 | A1 | 3/2007 | Pan et al. |
| 2007/0147518 | A1 | 6/2007 | Bessette |
| 2008/0082343 | A1 | 4/2008 | Maeda |
| 2008/0126904 | A1 | 5/2008 | Sung et al. |
| 2008/0221906 | A1 | 9/2008 | Nilsson et al. |
| 2009/0076805 | A1 | 3/2009 | Xu et al. |
| 2009/0076808 | A1 | 3/2009 | Xu et al. |
| 2009/0240490 | A1 | 9/2009 | Kim et al. |
| 2009/0248404 | A1 | 10/2009 | Ehara et al. |
| 2010/0070271 | A1 | 3/2010 | Kovesi et al. |
| 2010/0318349 | A1 | 12/2010 | Kovesi et al. |
| 2010/0324907 | A1 | 12/2010 | Virette et al. |
| 2011/0125505 | A1 | 5/2011 | Vaillancourt et al. |
| 2011/0200198 | A1 | 8/2011 | Grill et al. |
| 2011/0208517 | A1 | 8/2011 | Zopf |
| 2011/0218801 | A1 | 9/2011 | Vary et al. |
| 2012/0101814 | A1 | 4/2012 | Elias |
| 2016/0148618 | A1 | 5/2016 | Huang et al. |
| 2016/0240203 | A1 | 8/2016 | Lecomte |
| 2016/0247506 | A1 | 8/2016 | Lecomte |
| 2016/0379645 | A1 | 12/2016 | Lecomte |
| 2016/0379646 | A1 | 12/2016 | Lecomte |
| 2016/0379647 | A1 | 12/2016 | Lecomte |
| 2016/0379648 | A1 | 12/2016 | Lecomte |
| 2016/0379650 | A1 | 12/2016 | Lecomte |
| 2016/0379651 | A1 | 12/2016 | Lecomte |
| 2016/0379652 | A1 | 12/2016 | Lecomte |
| 2016/0379657 | A1 | 12/2016 | Lecomte |
| 2017/0372707 | A1 | 12/2017 | Biswas et al. |

FOREIGN PATENT DOCUMENTS

| | | |
|---|---|---|
| CN | 101573751 | 11/2009 |
| CN | 102124517 | 7/2011 |
| CN | 102171753 | 8/2011 |
| EP | 0673017 | 9/1995 |
| EP | 1087379 | 3/2001 |
| EP | 1168651 | 1/2002 |
| EP | 1288915 | 3/2003 |
| EP | 1207519 | 2/2013 |
| FR | 2907586 | 4/2008 |
| JP | 2011521290 | 7/2011 |
| JP | 2012533094 | 12/2012 |
| JP | 2016528535 | 9/2016 |
| WO | 0011651 | 3/2000 |
| WO | 01/86637 | 11/2001 |
| WO | 2002/059875 | 8/2002 |
| WO | 03/102921 | 12/2003 |
| WO | 03102921 | 12/2003 |
| WO | 2005/078706 | 8/2005 |
| WO | 2005078706 | 8/2005 |
| WO | 2007073604 | 7/2007 |
| WO | 2008/022176 | 2/2008 |
| WO | 2008022176 | 2/2008 |
| WO | 2008/074249 | 6/2008 |
| WO | 2010/003556 | 1/2010 |
| WO | 2012/110447 | 8/2012 |
| WO | 2014202535 | 12/2014 |
| WO | 2014202539 | 12/2014 |

OTHER PUBLICATIONS

3GPP TS 26.402: "General Audio Codec Audio Processing Functions; Enhanced aacPlus General Audio Codec; Additional Decoder Tools", 2009.

G. Fuchs, et al. "MDCT-Based Coder for Highly Adaptive Speech and Audio Coding", Aug. 24-28, 2009.

ISO IEC DIS 23003-3 (E); Information Technology—MPEG Audio Technologies—Part 3: "Unified Speech and Audio Coding", Mar. 2011.

Quackenbush: "MPEG Unified Speech and Audio Coding"; 43rd Intern. Conference: Audio for Wirelessly Networked Personal Devices; Sep. 29, 2011; XP040567663.

Parallel Russian Office Action dated Aug. 22, 2017 in Patent Application No. 2016121172/08.

3GPP TS 26.402 V8.0.0, "General Audio Codec Processing Functions; Enhanced aacPlus General Audio Codec; Additional Decoder Tools", Dec. 18, 2008.

3GPP TS 26.290 V8.0.0, "Audio Codec Processing Functions; Extended Adaptive Multi-Rate-Wideband (AMR-WB+) Codec; Transcoding Functions", Dec. 18, 2008.

Decision to Grant in parallel Singapore Application No. 11201603429S dated Jul. 13, 2017.

Office Action in parallel Russian Patent Application No. 2016121148 dated Jun. 26, 2017.

Office Action in parallel Singapore Patent Application No. 10201609234Q dated Jul. 26, 2017.

Parallel Singapore Application No. 11201603425U Office Action dated Jun. 8, 2017.

Schuyler Quakenbush, MPEG Unified Speech and Audio Coding, Conference 43 rd Intern. Conference: Audio for Wirelessly Networked Personal Devices; Sep. 29-Oct. 1, 2011.

(56) References Cited

OTHER PUBLICATIONS

European Search Report in parallel EP Application No. 17191502.8 dated Nov. 17, 2017.
Parallel Japanese Application No. 2016-527210 Office Action dated Aug. 1, 2017.
Parallel Japanese Application No. 2016-527456 Office Action dated Aug. 1, 2017.
"Audio Codec Processing Functions; Extended Adaptive Multi-Rate—Wideband (AMR-WB+) Codec; Transcoding Functions", 3GPP TS 26.290 version 7.0.0, Release 7, Mar. 2007.
ISO/IEC FDIS 23003-3:2011(E), "Information Technology—MPEG Audio Technologies—Part 3: Unified Speech and Audio Coding", ISO/IEC JTC 1/SC 29/WG 11, Sep. 2011.
Office Action in parallel Korean Patent Application No. 10-2016-7014227 dated Mar. 28, 2017.
Office Action in parallel Korean Patent Application No. 10-2016-7014335 dated Apr. 13, 2017.
General Audio Codex Audio Processing Functions Enhanced; aacPlus General Audio Codec; Additional Decoder Tools, 3GPP TS 26.402 version 6.1.0 Release 6, Sep. 2005.
G.729-Based Embedded Variable Bit-Rate Coder: An 8-32 kbit/s Scalable Wideband Coder Bitstream Interoperable with G.729. ITU-T Recommendation G.729.1, May 2006.
Recommendation ITU-T G.722. 7 kHz Audio-Coding within 64 kbit/s, Sep. 2012.
Parallel Korean Decision to Grant in Application No. 10-2016-7014227 dated Feb. 8, 2018.
Parallel Korean Office Action in Application No. 10-2017-7029243 dated Jan. 10, 2018.
Parallel Korean Office Action in Application No. 10-2017-7029244 dated Jan. 10, 2018.
Parallel Korean Office Action in Application No. 10-2017-7029245 dated Jan. 10, 2018.
Parallel Korean Office Action in Application No. 10-2017-7029246 dated Jan. 10, 2018.
Parallel Korean Office Action in Application No. 10-2017-7029247 dated Jan. 10, 2018.
EP Search Report dated May 7, 2018 in parallel EP Application No. 17207093.0.
Korean Office Action dated May 10, 2018 in parallel KR Application No. 10-2018-7005569.
Neuendorf M., et al. "MPEG Unified Speech and Audio Coding—the ISO/MPEG Standard for High-Efficiency Audio Coding of all Content Types", Audio Engineering Society Convention 132, Apr. 29, 2012.
Singapore Office Action in parallel Application No. 10201709061W dated Feb. 22, 2018.
Singapore Office Action in parallel Application No. 10201709062U dated Feb. 22, 2018.
European Search Report in parallel Application No. EP 17 20 1219 dated Apr. 3, 2018.
European Search Report in parallel Application No. EP 17 20 1222 dated Mar. 16, 2018.
G.7222 : A low-complexity algorithm for packet loss concealment with G.722. ITU-T Recommendation G.722 (1988) Appendix IV. Jul. 6, 2007.
Decision to Grant in parallel KR Patent Application No. 10-2017-7029243 dated Oct. 22, 2018.
RU Decision on Grant dated Nov. 13, 2018 in parallel RU Patent Application No. 2016121172.
Chinese Office Action in parallel CN Application No. 201480060290.7 dated Jan. 9, 2019.
Chinese Office Action in parallel CN Application No. 201480060303.0 dated Jan. 23, 2019.
Yu Shaohua, et al. "Research on Error-Resilient Techniques for Video and Audio Coding in T-DMB System", College of Information Engineering, Television Technology, No. 05, vol. 34, 2010.

| FIG 4 | |
|---|---|
| FIG 4A | FIG 4B |

| FIG 4 | |
|---|---|
| FIG 4A | FIG 4B |

Time domain concealment overview for transform decoder

Time domain concealment overview for switch codec

Block diagram of the TCX decoder

| FIG 7 | |
|---|---|
| FIG 7A | FIG 7B |

Block diagram of the TCX decoder

| FIG 7 | |
|---|---|
| FIG 7A | FIG 7B |

Block diagram of the TCX decoder

AUDIO DECODER AND METHOD FOR PROVIDING A DECODED AUDIO INFORMATION USING AN ERROR CONCEALMENT BASED ON A TIME DOMAIN EXCITATION SIGNAL

CROSS-REFERENCE TO RELATED APPLICATIONS

This application is a continuation of U.S. application Ser. No. 15/142,547, filed Apr. 29, 2016 which is a continuation of International Application No. PCT/EP2014/073035, filed Oct. 27, 2014, and additionally claims priority from European Applications Nos. EP13191133, filed Oct. 31, 2013, and EP14178824, filed Jul. 28, 2014, all of which are incorporated herein by reference in their entirety.

BACKGROUND OF THE INVENTION

Embodiments according to the invention create audio decoders for providing a decoded audio information on the basis of an encoded audio information.

Some embodiments according to the invention create methods for providing a decoded audio information on the basis of an encoded audio information.

Some embodiments according to the invention create computer programs for performing one of said methods.

Some embodiments according to the invention are related to a time domain concealment for a transform domain codec.

In recent years there is an increasing demand for a digital transmission and storage of audio contents. However, audio contents are often transmitted over unreliable channels, which brings along the risk that data units (for example, packets) comprising one or more audio frames (for example, in the form of an encoded representation, like, for example, an encoded frequency domain representation or an encoded time domain representation) are lost. In some situations, it would be possible to request a repetition (resending) of lost audio frames (or of data units, like packets, comprising one or more lost audio frames). However, this would typically bring a substantial delay, and would therefore necessitate an extensive buffering of audio frames. In other cases, it is hardly possible to request a repetition of lost audio frames.

In order to obtain a good, or at least acceptable, audio quality given the case that audio frames are lost without providing extensive buffering (which would consume a large amount of memory and which would also substantially degrade real time capabilities of the audio coding) it is desirable to have concepts to deal with a loss of one or more audio frames. In particular, it is desirable to have concepts which bring along a good audio quality, or at least an acceptable audio quality, even in the case that audio frames are lost.

In the past, some error concealment concepts have been developed, which can be employed in different audio coding concepts.

In the following, a conventional audio coding concept will be described.

In the 3gpp standard TS 26.290, a transform-coded-excitation decoding (TCX decoding) with error concealment is explained. In the following, some explanations will be provided, which are based on the section "TCX mode decoding and signal synthesis" in reference [1].

A TCX decoder according to the International Standard 3gpp TS 26.290 is shown in FIGS. 7 (shown in FIG. 7A and FIG. 7B) and 8, wherein FIGS. 7 and 8 show block diagrams of the TCX decoder. However, FIG. 7 shows those functional blocks which are relevant for the TCX decoding in a normal operation or a case of a partial packet loss. In contrast, FIG. 8 shows the relevant processing of the TCX decoding in case of TCX-256 packet erasure concealment.

Worded differently, FIGS. 7 and 8 show a block diagram of the TCX decoder including the following cases:

Case 1 (FIG. 8): Packet-erasure concealment in TCX-256 when the TCX frame length is 256 samples and the related packet is lost, i.e. BFI_TCX=(1); and Case 2 (FIG. 7): Normal TCX decoding, possibly with partial packet losses.

In the following, some explanations will be provided regarding FIGS. 7 and 8.

As mentioned, FIG. 7 shows a block diagram of a TCX decoder performing a TCX decoding in normal operation or in the case of partial packet loss. The TCX decoder 700 according to FIG. 7 receives TCX specific parameters 710 and provides, on the basis thereof, decoded audio information 712, 714.

The audio decoder 700 comprises a demultiplexer "DEMUX TCX 720", which is configured to receive the TCX-specific parameters 710 and the information "BFI_TCX". The demultiplexer 720 separates the TCX-specific parameters 710 and provides an encoded excitation information 722, an encoded noise fill-in information 724 and an encoded global gain information 726. The audio decoder 700 comprises an excitation decoder 730, which is configured to receive the encoded excitation information 722, the encoded noise fill-in information 724 and the encoded global gain information 726, as well as some additional information (like, for example, a bitrate flag "bit_rate_flag", an information "BFI_TCX" and a TCX frame length information. The excitation decoder 730 provides, on the basis thereof, a time domain excitation signal 728 (also designated with "x"). The excitation decoder 730 comprises an excitation information processor 732, which demultiplexes the encoded excitation information 722 and decodes algebraic vector quantization parameters. The excitation information processor 732 provides an intermediate excitation signal 734, which is typically in a frequency domain representation, and which is designated with Y. The excitation encoder 730 also comprises a noise injector 736, which is configured to inject noise in unquantized subbands, to derive a noise filled excitation signal 738 from the intermediate excitation signal 734. The noise filled excitation signal 738 is typically in the frequency domain, and is designated with Z. The noise injector 736 receives a noise intensity information 742 from a noise fill-in level decoder 740. The excitation decoder also comprises an adaptive low frequency de-emphasis 744, which is configured to perform a low-frequency de-emphasis operation on the basis of the noise filled excitation signal 738, to thereby obtain a processed excitation signal 746, which is still in the frequency domain, and which is designated with X'. The excitation decoder 730 also comprises a frequency domain-to-time domain transformer 748, which is configured to receive the processed excitation signal 746 and to provide, on the basis thereof, a time domain excitation signal 750, which is associated with a certain time portion represented by a set of frequency domain excitation parameters (for example, of the processed excitation signal 746). The excitation decoder 730 also comprises a scaler 752, which is configured to scale the time domain excitation signal 750 to thereby obtain a scaled time domain excitation signal 754. The scaler 752 receives a global gain information 756 from a global gain decoder 758, wherein, in return, the global gain decoder 758 receives the encoded global gain information 726. The excitation decoder 730 also comprises an overlap-add synthesis 760, which receives scaled time domain excitation signals 754 associated with a plurality of time portions. The overlap-add synthesis 760 performs an overlap-and-add operation (which may include a windowing operation) on the basis of the scaled time domain excitation signals 754, to obtain a temporally combined time domain excitation signal 728 for a longer period in time (longer than the periods in time for which the individual time domain excitation signals 750, 754 are provided).

The audio decoder 700 also comprises an LPC synthesis 770, which receives the time domain excitation signal 728 provided by the overlap-add synthesis 760 and one or more LPC coefficients defining an LPC synthesis filter function 772. The LPC synthesis 770 may, for example, comprise a first filter 774, which may, for example, synthesis-filter the time domain excitation signal 728, to thereby obtain the decoded audio signal 712. Optionally, the LPC synthesis 770 may also comprise a second synthesis filter 772 which is configured to synthesis-filter the output signal of the first filter 774 using another synthesis filter function, to thereby obtain the decoded audio signal 714.

In the following, the TCX decoding will be described in the case of a TCX-256 packet erasure concealment. FIG. 8 shows a block diagram of the TCX decoder in this case.

The packet erasure concealment 800 receives a pitch information 810, which is also designated with "pitch_tcx", and which is obtained from a previous decoded TCX frame.

For example, the pitch information 810 may be obtained using a dominant pitch estimator 747 from the processed excitation signal 746 in the excitation decoder 730 (during the "normal" decoding). Moreover, the packet erasure concealment 800 receives LPC parameters 812, which may represent an LPC synthesis filter function. The LPC parameters 812 may, for example, be identical to the LPC parameters 772. Accordingly, the packet erasure concealment 800 may be configured to provide, on the basis of the pitch information 810 and the LPC parameters 812, an error concealment signal 814, which may be considered as an error concealment audio information. The packet erasure concealment 800 comprises an excitation buffer 820, which may, for example, buffer a previous excitation. The excitation buffer 820 may, for example, make use of the adaptive codebook of ACELP, and may provide an excitation signal 822. The packet erasure concealment 800 may further comprise a first filter 824, a filter function of which may be defined as shown in FIG. 8. Thus, the first filter 824 may filter the excitation signal 822 on the basis of the LPC parameters 812, to obtain a filtered version 826 of the excitation signal 822. The packet erasure concealment also comprises an amplitude limiter 828, which may limit an amplitude of the filtered excitation signal 826 on the basis of target information or level information $rms_{wsyn}$. Moreover, the packet erasure concealment 800 may comprise a second filter 832, which may be configured to receive the amplitude limited filtered excitation signal 830 from the amplitude limiter 822 and to provide, on the basis thereof, the error concealment signal 814. A filter function of the second filter 832 may, for example, be defined as shown in FIG. 8.

In the following, some details regarding the decoding and error concealment will be described.

In Case 1 (packet erasure concealment in TCX-256), no information is available to decode the 256-sample TCX frame. The TCX synthesis is found by processing the past excitation delayed by T, where T=pitch_tcx is a pitch lag estimated in the previously decoded TCX frame, by a non-linear filter roughly equivalent to $1/\hat{A}(z)$. A non-linear filter is used instead of $1/\hat{A}(z)$ to avoid clicks in the synthesis. This filter is decomposed in 3 steps:

Step 1: filtering by $$\frac{\hat{A}(z/\gamma)}{\hat{A}(z)}\frac{1}{1-\alpha z^{-1}}$$

to map the excitation delayed by T into the TCX target domain;

Step 2: applying a limiter (the magnitude is limited to $\pm rms_{wsyn}$)

Step 3: filtering by $$\frac{1-\alpha z^{-1}}{\hat{A}(z/\gamma)}$$

to find the synthesis. Note that the buffer OVLP_TCX is set to zero in this case.

Decoding of the Algebraic VQ Parameters

In Case 2, TCX decoding involves decoding the algebraic VQ parameters describing each quantized block $\hat{B}'_k$ of the scaled spectrum X', where X' is as described in Step 2 of Section 5.3.5.7 of 3gpp TS 26.290. Recall that X' has dimension N, where N=288, 576 and 1152 for TCX-256, 512 and 1024 respectively, and that each block $B'_k$ has dimension 8. The number K of blocks $B'_k$ is thus 36, 72 and 144 for TCX-256, 512 and 1024 respectively. The algebraic VQ parameters for each block $B'_k$ are described in Step 5 of Section 5.3.5.7. For each block $B'_k$, three sets of binary indices are sent by the encoder:

a) the codebook index $n_k$, transmitted in unary code as described in Step 5 of Section 5.3.5.7;

b) the rank $I_k$ of a selected lattice point c in a so-called base codebook, which indicates what permutation has to be applied to a specific leader (see Step 5 of Section 5.3.5.7) to obtain a lattice point c;

c) and, if the quantized block $\hat{B}'_k$ (a lattice point) was not in the base codebook, the 8 indices of the Voronoi extension index vector k calculated in sub-step V1 of Step 5 in Section; from the Voronoi extension indices, an extension vector z can be computed as in reference [1] of 3gpp TS 26.290. The number of bits in each component of index vector k is given by the extension order r, which can be obtained from the unary code value of index $n_k$. The scaling factor M of the Voronoi extension is given by $M=2^r$.

Then, from the scaling factor M, the Voronoi extension vector z (a lattice point in $RE_8$) and the lattice point c in the base codebook (also a lattice point in $RE_8$), each quantized scaled block $\hat{B}'_k$ can be computed as $$\hat{B}'_k=Mc+z$$

When there is no Voronoi extension (i.e. $n_k<5$, M=1 and z=0), the base codebook is either codebook $Q_0$, $Q_2$, $Q_3$ or $Q_4$ from reference [1] of 3gpp TS 26.290. No bits are then necessitated to transmit vector k. Otherwise, when Voronoi extension is used because $\hat{B}'_k$ is large enough, then only $Q_3$ or $Q_4$ from reference [1] is used as a base codebook. The selection of $Q_3$ or $Q_4$ is implicit in the codebook index value $n_k$, as described in Step 5 of Section 5.3.5.7.

Estimation of the Dominant Pitch Value

The estimation of the dominant pitch is performed so that the next frame to be decoded can be properly extrapolated if it corresponds to TCX-256 and if the related packet is lost. This estimation is based on the assumption that the peak of maximal magnitude in spectrum of the TCX target corresponds to the dominant pitch. The search for the maximum M is restricted to a frequency below Fs/64 kHz $$M=\max_{i=1 \ldots N/32} (X'_{2i})^2+(X'_{2i+1})^2$$

and the minimal index $1 \leq i_{max} \leq N/32$ such that $(X'_{2i})^2+(X'_{2i+1})^2=M$ is also found. Then the dominant pitch is estimated in number of samples as $T_{est}=N/i_{max}$ (this value may not be integer). Recall that the dominant pitch is calculated for packet-erasure concealment in TCX-256. To avoid buffering problems (the excitation buffer being limited to 256 samples), if $T_{est}>256$ samples, pitch_tcx is set to 256; otherwise, if $T_{est} \leq 256$, multiple pitch period in 256 samples are avoided by setting pitch_tcx to $$\text{pitch_tcx}=\max \{\lfloor n\ T_{est} \rfloor | n \text{ integer}>0 \text{ and } n\ T_{est} \leq 256\}$$

where $\lfloor \bullet \rfloor$ denotes the rounding to the nearest integer towards $-\infty$.

In the following, some further conventional concepts will be briefly discussed.

In ISO_IEC_DIS_23003-3 (reference [3]), a TCX decoding employing MDCT is explained in the context of the Unified Speech and Audio Codec.

In the AAC state of the art (confer, for example, reference [4]), only an interpolation mode is described. According to reference [4], the AAC core decoder includes a concealment function that increases the delay of the decoder by one frame.

In the European Patent EP 1207519 B1 (reference [5]), it is described to provide a speech decoder and error compensation method capable of achieving further improvement for decoded speech in a frame in which an error is detected. According to the patent, a speech coding parameter includes mode information which expresses features of each short segment (frame) of speech. The speech coder adaptively calculates lag parameters and gain parameters used for speech decoding according to the mode information. Moreover, the speech decoder adaptively controls the ratio of adaptive excitation gain and fixed gain excitation gain according to the mode information. Moreover, the concept according to the patent comprises adaptively controlling adaptive excitation gain parameters and fixed excitation gain parameters used for speech decoding according to values of decoded gain parameters in a normal decoding unit in which no error is detected, immediately after a decoding unit whose coded data is detected to contain an error.

In view of the conventional technology, there is a need for an additional improvement of the error concealment, which provides for a better hearing impression.

SUMMARY

According to an embodiment, an audio decoder for providing a decoded audio information on the basis of an encoded audio information may have: an error concealment configured to provide an error concealment audio information for concealing a loss of an audio frame following an audio frame encoded in a frequency domain representation using a time domain excitation signal; wherein the error concealment is configured to combine an extrapolated time domain excitation signal and a noise signal, in order to obtain an input signal for an LPC synthesis, and wherein the error concealment is configured to perform the LPC synthesis, wherein the LPC synthesis is configured to filter the input signal of the LPC synthesis in dependence on linear-prediction-coding parameters, in order to obtain the error concealment audio information; wherein the error concealment is configured to high-pass filter the noise signal which is combined with the extrapolated time domain excitation signal.

According to another embodiment, an audio decoder for providing a decoded audio information on the basis of an encoded audio information may have: an error concealment configured to provide an error concealment audio information for concealing a loss of an audio frame following an audio frame encoded in a frequency domain representation using a time domain excitation signal; wherein the error concealment is configured to copy a pitch cycle of the time domain excitation signal derived from the audio frame encoded in the frequency domain representation preceding the lost audio frame one time or multiple times, in order to obtain a excitation signal for a synthesis of the error concealment audio information; wherein the error concealment is configured to low-pass filter the pitch cycle of the time domain excitation signal derived from the time domain representation of the audio frame encoded in the frequency domain representation preceding the lost audio frame using a sampling-rate dependent filter, a bandwidth of which is dependent on a sampling rate of the audio frame encoded in a frequency domain representation.

According to another embodiment, an audio decoder for providing a decoded audio information on the basis of an encoded audio information may have: an error concealment configured to provide an error concealment audio information for concealing a loss of an audio frame following an audio frame encoded in a frequency domain representation using a time domain excitation signal; wherein the error concealment is configured to modify a time domain excitation signal obtained on the basis of one or more audio frames preceding a lost audio frame, in order to obtain the error concealment audio information; wherein the error concealment is configured to modify the time domain excitation signal obtained on the basis of one or more audio frames preceding a lost audio frame, or one or more copies thereof, to thereby reduce a periodic component of the error concealment audio information over time; wherein the error concealment is configured to gradually reduce a gain applied to scale the time domain excitation signal obtained on the basis of one or more audio frames preceding a lost audio frame, or the one or more copies thereof; wherein the error concealment is configured to adjust the speed used to gradually reduce a gain applied to scale the time domain excitation signal obtained on the basis of one or more audio frames preceding a lost audio frame, or the one or more copies thereof, in dependence on a length of a pitch period of the time domain excitation signal, such that a time domain excitation signal input into an LPC synthesis is faded out faster for signals having a shorter length of the pitch period when compared to signals having a larger length of the pitch period.

According to another embodiment, an audio decoder for providing a decoded audio information on the basis of an encoded audio information may have: an error concealment configured to provide an error concealment audio information for concealing a loss of an audio frame following an audio frame encoded in a frequency domain representation using a time domain excitation signal; wherein the error concealment is configured to modify a time domain excitation signal obtained on the basis of one or more audio frames preceding a lost audio frame, in order to obtain the error concealment audio information; wherein the error concealment is configured to time-scale the time domain excitation signal obtained on the basis of one or more audio frames preceding a lost audio frame, or the one or more copies thereof, in dependence on a prediction of a pitch for the time of the one or more lost audio frames.

According to another embodiment, an audio decoder for providing a decoded audio information on the basis of an encoded audio information may have: an error concealment configured to provide an error concealment audio information for concealing a loss of an audio frame following an audio frame encoded in a frequency domain representation using a time domain excitation signal; wherein the error concealment is configured to modify a time domain excitation signal obtained on the basis of one or more audio frames preceding a lost audio frame, in order to obtain the error concealment audio information; wherein the error concealment is configured to modify the time domain excitation signal obtained on the basis of one or more audio frames preceding a lost audio frame, or one or more copies thereof, to thereby reduce a periodic component of the error concealment audio information over time, or wherein the error concealment is configured to scale the time domain excitation signal obtained on the basis of one or more audio frames preceding the lost audio frame, or one or more copies thereof, to thereby modify the time domain excitation signal; wherein the error concealment is configured to adjust the speed used to gradually reduce a gain applied to scale the time domain excitation signal obtained on the basis of one or more audio frames preceding a lost audio frame, or the one or more copies thereof, in dependence on a result of a pitch analysis or a pitch prediction, such that a deterministic component of a time domain excitation signal input into an LPC synthesis is faded out faster for signals having a larger pitch change per time unit when compared to signals having a smaller pitch change per time unit, and/or such that a deterministic component of a time domain excitation signal input into an LPC synthesis is faded out faster for signals for which a pitch prediction fails when compared to signals for which the pitch prediction succeeds.

According to another embodiment, a method for providing a decoded audio information on the basis of an encoded audio information may have the steps of: providing an error concealment audio information for concealing a loss of an audio frame following an audio frame encoded in a frequency domain representation using a time domain excitation signal; wherein the method includes combining an extrapolated time domain excitation signal and a noise signal, in order to obtain an input signal for an LPC synthesis, and wherein the method includes performing the LPC synthesis, wherein the LPC synthesis filters the input signal of the LPC synthesis in dependence on linear-prediction-coding parameters, in order to obtain the error concealment audio information; wherein the method includes high-pass filtering the noise signal which is combined with the extrapolated time domain excitation signal.

According to another embodiment, a method for providing a decoded audio information on the basis of an encoded audio information may have the steps of: providing an error concealment audio information for concealing a loss of an audio frame following an audio frame encoded in a frequency domain representation using a time domain excitation signal; and applying a scale-factor-based scaling to a plurality of spectral values derived from the frequency-domain representation; wherein the error concealment audio information for concealing a loss of an audio frame following an audio frame encoded in a frequency domain representation including a plurality of encoded scale factors is provided using a time domain excitation signal derived from the frequency domain representation; wherein the time domain excitation signal is obtained on the basis of the audio frame encoded in the frequency domain representation preceding a lost audio frame.

According to another embodiment, a method for providing a decoded audio information on the basis of an encoded audio information may have the steps of: providing an error concealment audio information for concealing a loss of an audio frame following an audio frame encoded in a frequency domain representation using a time domain excitation signal; wherein the frequency domain representation includes an encoded representation of a plurality of spectral values and an encoded representation of a plurality of scale factors for scaling the spectral values, and wherein a plurality of decoded scale factors for scaling spectral values is provided on the basis of a plurality of encoded scale factors, or wherein the plurality of scale factors for scaling the spectral values is derived from an encoded representation of LPC parameters; and wherein the time domain excitation signal is obtained on the basis of the audio frame encoded in the frequency domain representation preceding a lost audio frame.

According to another embodiment, a method for providing a decoded audio information on the basis of an encoded audio information may have the steps of: providing an error concealment audio information for concealing a loss of an audio frame following an audio frame encoded in a frequency domain representation using a time domain excitation signal wherein a pitch cycle of the time domain excitation signal derived from the audio frame encoded in the frequency domain representation preceding the lost audio frame is copied one time or multiple times, in order to obtain a excitation signal for a synthesis of the error concealment audio information; wherein the pitch cycle of the time domain excitation signal derived from the time domain representation of the audio frame encoded in the frequency domain representation preceding the lost audio frame is low-pass-filtered using a sampling-rate dependent filter, a bandwidth of which is dependent on a sampling rate of the audio frame encoded in a frequency domain representation.

According to another embodiment, a method for providing a decoded audio information on the basis of an encoded audio information may have the steps of: providing an error concealment audio information for concealing a loss of an audio frame following an audio frame encoded in a frequency domain representation using a time domain excitation signal wherein a time domain excitation signal obtained on the basis of one or more audio frames preceding a lost audio frame is modified, in order to obtain the error concealment audio information; wherein the time domain excitation signal obtained on the basis of one or more audio frames preceding a lost audio frame, or one or more copies thereof, is modified to thereby reduce a periodic component of the error concealment audio information over time; wherein a gain applied to scale the time domain excitation signal obtained on the basis of one or more audio frames preceding a lost audio frame, or the one or more copies thereof, is gradually reduced; wherein the speed used to gradually reduce a gain applied to scale the time domain excitation signal obtained on the basis of one or more audio frames preceding a lost audio frame, or the one or more copies thereof, is adjusted in dependence on a length of a pitch period of the time domain excitation signal, such that a time domain excitation signal input into an LPC synthesis is faded out faster for signals having a shorter length of the pitch period when compared to signals having a larger length of the pitch period.

According to another embodiment, a method for providing a decoded audio information on the basis of an encoded audio information may have the steps of: providing an error concealment audio information for concealing a loss of an audio frame following an audio frame encoded in a frequency domain representation using a time domain excitation signal; wherein a time domain excitation signal obtained on the basis of one or more audio frames preceding a lost audio frame is modified, in order to obtain the error concealment audio information; wherein the time domain excitation signal obtained on the basis of one or more audio frames preceding a lost audio frame, or the one or more copies thereof, is time-scaled in dependence on a prediction of a pitch for the time of the one or more lost audio frames.

According to an embodiment, a method for providing a decoded audio information on the basis of an encoded audio information may have the steps of: providing an error concealment audio information for concealing a loss of an audio frame following an audio frame encoded in a frequency domain representation using a time domain excitation signal; wherein the method includes modifying a time domain excitation signal obtained on the basis of one or more audio frames preceding a lost audio frame, in order to obtain the error concealment audio information, wherein the time domain excitation signal obtained on the basis of one or more audio frames preceding a lost audio frame, or one or more copies thereof, is modified to thereby reduce a periodic component of the error concealment audio information over time, or wherein the time domain excitation signal obtained on the basis of one or more audio frames preceding the lost audio frame, or one or more copies thereof, is scaled to thereby modify the time domain excitation signal; wherein the speed used to gradually reduce a gain applied to scale the time domain excitation signal obtained on the basis of one or more audio frames preceding a lost audio frame, or the one or more copies thereof, is adjusted in dependence on a result of a pitch analysis or a pitch prediction, such that a deterministic component of a time domain excitation signal input into an LPC synthesis is faded out faster for signals having a larger pitch change per time unit when compared to signals having a smaller pitch change per time unit, and/or such that a deterministic component of a time domain excitation signal input into an LPC synthesis is faded out faster for signals for which a pitch prediction fails when compared to signals for which the pitch prediction succeeds.

Another embodiment may have a non-transitory digital storage medium having a computer program stored thereon to perform the inventive methods when said computer program is run by a computer.

An embodiment according to the invention creates an audio decoder for providing a decoded audio information on the basis of an encoded audio information. The audio decoder comprises an error concealment configured to provide an error concealment audio information for concealing a loss of an audio frame (or more than one frame loss) following an audio frame encoded in a frequency domain representation, using a time domain excitation signal.

This embodiment according to the invention is based on the finding that an improved error concealment can be obtained by providing the error concealment audio information on the basis of a time domain excitation signal even if the audio frame preceding a lost audio frame is encoded in a frequency domain representation. In other words, it has been recognized that a quality of an error concealment is typically better if the error concealment is performed on the basis of a time domain excitation signal, when compared to an error concealment performed in a frequency domain, such that it is worth switching to time domain error concealment, using a time domain excitation signal, even if the audio content preceding the lost audio frame is encoded in the frequency domain (i.e. in a frequency domain representation). That is, for example, true for a monophonic signal and mostly for speech.

Accordingly, the present invention allows to obtain a good error concealment even if the audio frame preceding the lost audio frame is encoded in the frequency domain (i.e. in a frequency domain representation).

In an embodiment, the frequency domain representation comprises an encoded representation of a plurality of spectral values and an encoded representation of a plurality of scale factors for scaling the spectral values, or the audio decoder is configured to derive a plurality of scale factors for scaling the spectral values from an encoded representation of LPC parameters. That could be done by using FDNS (Frequency Domain Noise Shaping). However, it has been found that it is worth deriving a time domain excitation signal (which may serve as an excitation for a LPC synthesis) even if the audio frame preceding the lost audio frame is originally encoded in the frequency domain representation comprising substantially different information (namely, an encoded representation of a plurality of spectral values in an encoded representation of a plurality of scale factors for scaling the spectral values). For example, in case of TCX we do not send scale factors (from an encoder to a decoder) but LPC and then in the decoder we transform the LPC to a scale factor representation for the MDCT bins. Worded differently, in case of TCX we send the LPC coefficient and then in the decoder we transform those LPC coefficients to a scale factor representation for TCX in USAC or in AMR-WB+ there is no scale factor at all.

In an embodiment, the audio decoder comprises a frequency-domain decoder core configured to apply a scale-factor-based scaling to a plurality of spectral values derived from the frequency-domain representation. In this case, the error concealment is configured to provide the error concealment audio information for concealing a loss of an audio frame following an audio frame encoded in the frequency domain representation comprising a plurality of encoded scale factors using a time domain excitation signal derived from the frequency domain representation. This embodiment according to the invention is based on the finding that the derivation of the time domain excitation signal from the above mentioned frequency domain representation typically provides for a better error concealment result when compared to an error concealment which was performed directly in the frequency domain. For example, the excitation signal is created based on the synthesis of the previous frame, then doesn't really matter whether the previous frame is a frequency domain (MDCT, FFT . . . ) or a time domain frame. However, particular advantages can be observed if the previous frame was a frequency domain. Moreover, it should be noted that particularly good results are achieved, for example, for monophonic signal like speech. As another example, the scale factors might be transmitted as LPC coefficients, for example using a polynomial representation which is then converted to scale factors on decoder side.

In an embodiment, the audio decoder comprises a frequency domain decoder core configured to derive a time domain audio signal representation from the frequency domain representation without using a time domain excitation signal as an intermediate quantity for the audio frame encoded in the frequency domain representation. In other words, it has been found that the usage of a time domain excitation signal for an error concealment is advantageous even if the audio frame preceding the lost audio frame is encoded in a "true" frequency mode which does not use any time domain excitation signal as an intermediate quantity (and which is consequently not based on an LPC synthesis).

In an embodiment, the error concealment is configured to obtain the time domain excitation signal on the basis of the audio frame encoded in the frequency domain representation preceding a lost audio frame. In this case, the error concealment is configured to provide the error concealment audio information for concealing the lost audio frame using said time domain excitation signal. In other words, it has been recognized the time domain excitation signal, which is used for the error concealment, should be derived from the audio frame encoded in the frequency domain representation preceding the lost audio frame, because this time domain excitation signal derived from the audio frame encoded in the frequency domain representation preceding the lost audio frame provides a good representation of an audio content of the audio frame preceding the lost audio frame, such that the error concealment can be performed with moderate effort and good accuracy.

In an embodiment, the error concealment is configured to perform an LPC analysis on the basis of the audio frame encoded in the frequency domain representation preceding the lost audio frame, to obtain a set of linear-prediction-coding parameters and the time-domain excitation signal representing an audio content of the audio frame encoded in the frequency domain representation preceding the lost audio frame. It has been found that it is worth the effort to perform an LPC analysis, to derive the linear-prediction-coding parameters and the time-domain excitation signal, even if the audio frame preceding the lost audio frame is encoded in a frequency domain representation (which does not contain any linear-prediction coding parameters and no representation of a time domain excitation signal), since a good quality error concealment audio information can be obtained for many input audio signals on the basis of said time domain excitation signal. Alternatively, the error concealment may be configured to perform an LPC analysis on the basis of the audio frame encoded in the frequency domain representation preceding the lost audio frame, to obtain the time-domain excitation signal representing an audio content of the audio frame encoded in the frequency domain representation preceding the lost audio frame. Further alternatively, the audio decoder may be configured to obtain a set of linear-prediction-coding parameters using a linear-prediction-coding parameter estimation, or the audio decoder may be configured to obtain a set of linear-prediction-coding parameters on the basis of a set of scale factors using a transform. Worded differently, the LPC parameters may be obtained using the LPC parameter estimation. That could be done either by windowing/autocorr/levinson durbin on the basis of the audio frame encoded in the frequency domain representation or by transformation from the previous scale factor directly to and LPC representation.

In an embodiment, the error concealment is configured to obtain a pitch (or lag) information describing a pitch of the audio frame encoded in the frequency domain preceding the lost audio frame, and to provide the error concealment audio information in dependence on the pitch information. By taking into consideration the pitch information, it can be achieved that the error concealment audio information (which is typically an error concealment audio signal covering the temporal duration of at least one lost audio frame) is well adapted to the actual audio content.

In an embodiment, the error concealment is configured to obtain the pitch information on the basis of the time domain excitation signal derived from the audio frame encoded in the frequency domain representation preceding the lost audio frame. It has been found that a derivation of the pitch information from the time domain excitation signal brings along a high accuracy. Moreover, it has been found that it is advantageous if the pitch information is well adapted to the time domain excitation signal, since the pitch information is used for a modification of the time domain excitation signal. By deriving the pitch information from the time domain excitation signal, such a close relationship can be achieved.

In an embodiment, the error concealment is configured to evaluate a cross correlation of the time domain excitation signal, to determine a coarse pitch information. Moreover, the error concealment may be configured to refine the coarse pitch information using a closed loop search around a pitch determined by the coarse pitch information. Accordingly, a highly accurate pitch information can be achieved with moderate computational effort.

In an embodiment, the audio decoder the error concealment may be configured to obtain a pitch information on the basis of a side information of the encoded audio information.

In an embodiment, the error concealment may be configured to obtain a pitch information on the basis of a pitch information available for a previously decoded audio frame.

In an embodiment, the error concealment is configured to obtain a pitch information on the basis of a pitch search performed on a time domain signal or on a residual signal.

Worded differently, the pitch can be transmitted as side info or could also come from the previous frame if there is LTP for example. The pitch information could also be transmit in the bitstream if available at the encoder. We can do optionally the pitch search on the time domain signal directly or on the residual, that give usually better results on the residual (time domain excitation signal).

In an embodiment, the error concealment is configured to copy a pitch cycle of the time domain excitation signal derived from the audio frame encoded in the frequency domain representation preceding the lost audio frame one time or multiple times, in order to obtain an excitation signal for a synthesis of the error concealment audio signal. By copying the time domain excitation signal one time or multiple times, it can be achieved that the deterministic (i.e. substantially periodic) component of the error concealment audio information is obtained with good accuracy and is a good continuation of the deterministic (e.g. substantially periodic) component of the audio content of the audio frame preceding the lost audio frame.

In an embodiment, the error concealment is configured to low-pass filter the pitch cycle of the time domain excitation signal derived from the frequency domain representation of the audio frame encoded in the frequency domain representation preceding the lost audio frame using a sampling-rate dependent filter, a bandwidth of which is dependent on a sampling rate of the audio frame encoded in a frequency domain representation. Accordingly, the time domain excitation signal can be adapted to an available audio bandwidth, which results in a good hearing impression of the error concealment audio information. For example, it is advantageous to low pass only on the first lost frame, and we also low pass only if the signal is not 100% stable. However, it should be noted that the low-pass-filtering is optional, and may be performed only on the first pitch cycle. Fore example, the filter may be sampling-rate dependent, such that the cut-off frequency is independent of the bandwidth.

In an embodiment, error concealment is configured to predict a pitch at an end of a lost frame to adapt the time domain excitation signal, or one or more copies thereof, to the predicted pitch. Accordingly, expected pitch changes during the lost audio frame can be considered. Consequently, artifacts at a transition between the error concealment audio information and an audio information of a properly decoded frame following one or more lost audio frames are avoided (or at least reduced, since that is only a predicted pitch not the real one). For example, the adaptation is going from the last good pitch to the predicted one. That is done by the pulse resynchronization [7]

In an embodiment, the error concealment is configured to combine an extrapolated time domain excitation signal and a noise signal, in order to obtain an input signal for an LPC synthesis. In this case, the error concealment is configured to perform the LPC synthesis, wherein the LPC synthesis is configured to filter the input signal of the LPC synthesis in dependence on linear-prediction-coding parameters, in order to obtain the error concealment audio information. Accordingly, both a deterministic (for example, approximately periodic) component of the audio content and a noise-like component of the audio content can be considered. Accordingly, it is achieved that the error concealment audio information comprises a "natural" hearing impression.

In an embodiment, the error concealment is configured to compute a gain of the extrapolated time domain excitation signal, which is used to obtain the input signal for the LPC synthesis, using a correlation in the time domain which is performed on the basis of a time domain representation of the audio frame encoded in the frequency domain preceding the lost audio frame, wherein a correlation lag is set in dependence on a pitch information obtained on the basis of the time-domain excitation signal. In other words, an intensity of a periodic component is determined within the audio frame preceding the lost audio frame, and this determined intensity of the periodic component is used to obtain the error concealment audio information. However, it has been found that the above mentioned computation of the intensity of the period component provides particularly good results, since the actual time domain audio signal of the audio frame preceding the lost audio frame is considered. Alternatively, a correlation in the excitation domain or directly in the time domain may be used to obtain the pitch information. However, there are also different possibilities, depending on which embodiment is used. In an embodiment, the pitch information could be only the pitch obtained from the ltp of last frame or the pitch that is transmitted as side info or the one calculated.

In an embodiment, the error concealment is configured to high-pass filter the noise signal which is combined with the extrapolated time domain excitation signal. It has been found that high pass filtering the noise signal (which is typically input into the LPC synthesis) results in a natural hearing impression. For example, the high pass characteristic may be changing with the amount of frame lost, after a certain amount of frame loss there may be no high pass anymore. The high pass characteristic may also be dependent of the sampling rate the decoder is running. For example, the high pass is sampling rate dependent, and the filter characteristic may change over time (over consecutive frame loss). The high pass characteristic may also optionally be changed over consecutive frame loss such that after a certain amount of frame loss there is no filtering anymore to only get the full band shaped noise to get a good comfort noise closed to the background noise.

In an embodiment, the error concealment is configured to selectively change the spectral shape of the noise signal (562) using the pre-emphasis filter wherein the noise signal is combined with the extrapolated time domain excitation signal if the audio frame encoded in a frequency domain representation preceding the lost audio frame is a voiced audio frame or comprises an onset. It has been found that the hearing impression of the error concealment audio information can be improved by such a concept. For example, in some case it is better to decrease the gains and shape and in some place it is better to increase it.

In an embodiment, the error concealment is configured to compute a gain of the noise signal in dependence on a correlation in the time domain, which is performed on the basis of a time domain representation of the audio frame encoded in the frequency domain representation preceding the lost audio frame. It has been found that such determination of the gain of the noise signal provides particularly accurate results, since the actual time domain audio signal associated with the audio frame preceding the lost audio frame can be considered. Using this concept, it is possible to be able to get an energy of the concealed frame close to the energy of the previous good frame. For example, the gain for the noise signal may be generated by measuring the energy of the result: excitation of input signal—generated pitch based excitation.

In an embodiment, the error concealment is configured to modify a time domain excitation signal obtained on the basis of one or more audio frames preceding a lost audio frame, in order to obtain the error concealment audio information. It has been found that the modification of the time domain excitation signal allows to adapt the time domain excitation signal to a desired temporal evolution. For example, the modification of the time domain excitation signal allows to "fade out" the deterministic (for example, substantially periodic) component of the audio content in the error concealment audio information. Moreover, the modification of the time domain excitation signal also allows to adapt the time domain excitation signal to an (estimated or expected) pitch variation. This allows to adjust the characteristics of the error concealment audio information over time.

In an embodiment, the error concealment is configured to use one or more modified copies of the time domain excitation signal obtained on the basis of one or more audio frames preceding a lost audio frame, in order to obtain the error concealment information. Modified copies of the time domain excitation signal can be obtained with a moderate effort, and the modification may be performed using a simple algorithm. Thus, desired characteristics of the error concealment audio information can be achieved with moderate effort.

In an embodiment, the error concealment is configured to modify the time domain excitation signal obtained on the basis of one or more audio frames preceding a lost audio frame, or one or more copies thereof, to thereby reduce a periodic component of the error concealment audio information over time. Accordingly, it can be considered that the correlation between the audio content of the audio frame preceding the lost audio frame and the audio content of the one or more lost audio frames decreases over time. Also, it can be avoided that an unnatural hearing impression is caused by a long preservation of a periodic component of the error concealment audio information.

In an embodiment, the error concealment is configured to scale the time domain excitation signal obtained on the basis of one or more audio frames preceding the lost audio frame, or one or more copies thereof, to thereby modify the time domain excitation signal. It has been found that the scaling operation can be performed with little effort, wherein the scaled time domain excitation signal typically provides a good error concealment audio information.

In an embodiment, the error concealment is configured to gradually reduce a gain applied to scale the time domain excitation signal obtained on the basis of one or more audio frames preceding a lost audio frame, or the one or more copies thereof. Accordingly, a fade out of the periodic component can be achieved within the error concealment audio information.

In an embodiment, the error concealment is configured to adjust a speed used to gradually reduce a gain applied to scale the time domain excitation signal obtained on the basis of one or more audio frames preceding a lost audio frame, or the one or more copies thereof, in dependence on one or more parameters of one or more audio frames preceding the lost audio frame, and/or in dependence on a number of consecutive lost audio frames. Accordingly, it is possible to adjust the speed at which the deterministic (for example, at least approximately periodic) component is faded out in the error concealment audio information. The speed of the fade out can be adapted to specific characteristics of the audio content, which can typically be seen from one or more parameters of the one or more audio frames preceding the lost audio frame. Alternatively, or in addition, the number of consecutive lost audio frames can be considered when determining the speed used to fade out the deterministic (for example, at least approximately periodic) component of the error concealment audio information, which helps to adapt the error concealment to the specific situation. For example, the gain of the tonal part and the gain of the noisy part may be faded out separately. The gain for the tonal part may converge to zero after a certain amount of frame loss whereas the gain of noise may converge to the gain determined to reach a certain comfort noise.

In an embodiment, the error concealment is configured to adjust the speed used to gradually reduce a gain applied to scale the time domain excitation signal obtained on the basis of one or more audio frames preceding a lost audio frame, or the one or more copies thereof, in dependence on a length of a pitch period of the time domain excitation signal, such that a time domain excitation signal input into an LPC synthesis is faded out faster for signals having a shorter length of the pitch period when compared to signals having a larger length of the pitch period. Accordingly, it can be avoided that signals having a shorter length of the pitch period are repeated too often with high intensity, because this would typically result in an unnatural hearing impression. Thus, an overall quality of the error concealment audio information can be improved.

In an embodiment, the error concealment is configured to adjust the speed used to gradually reduce a gain applied to scale the time domain excitation signal obtained on the basis of one or more audio frames preceding a lost audio frame, or the one or more copies thereof, in dependence on a result of a pitch analysis or a pitch prediction, such that a deterministic component of the time domain excitation signal input into an LPC synthesis is faded out faster for signals having a larger pitch change per time unit when compared to signals having a smaller pitch change per time unit, and/or such that a deterministic component of the time domain excitation signal input into an LPC synthesis is faded out faster for signals for which a pitch prediction fails when compared to signals for which the pitch prediction succeeds. Accordingly, the fade out can be made faster for signals in which there is a large uncertainty of the pitch when compared to signals for which there is a smaller uncertainty of the pitch. However, by fading out a deterministic component faster for signals which comprise a comparatively large uncertainty of the pitch, audible artifacts can be avoided or at least reduced substantially.

In an embodiment, the error concealment is configured to time-scale the time domain excitation signal obtained on the basis of one or more audio frames preceding a lost audio frame, or the one or more copies thereof, in dependence on a prediction of a pitch for the time of the one or more lost audio frames. Accordingly, the time domain excitation signal can be adapted to a varying pitch, such that the error concealment audio information comprises a more natural hearing impression.

In an embodiment, the error concealment is configured to provide the error concealment audio information for a time which is longer than a temporal duration of the one or more lost audio frames. Accordingly, it is possible to perform an overlap-and-add operation on the basis of the error concealment audio information, which helps to reduce blocking artifacts.

In an embodiment, the error concealment is configured to perform an overlap-and-add of the error concealment audio information and of a time domain representation of one or more properly received audio frames following the one or more lost audio frames. Thus, it is possible to avoid (or at least reduce) blocking artifacts.

In an embodiment, the error concealment is configured to derive the error concealment audio information on the basis of at least three partially overlapping frames or windows preceding a lost audio frame or a lost window. Accordingly, the error concealment audio information can be obtained with good accuracy even for coding modes in which more than two frames (or windows) are overlapped (wherein such overlap may help to reduce a delay).

Another embodiment according to the invention creates a method for providing a decoded audio information on the basis of an encoded audio information. The method comprises providing an error concealment audio information for concealing a loss of an audio frame following an audio frame encoded in a frequency domain representation using a time domain excitation signal. This method is based on the same considerations as the above mentioned audio decoder.

Yet another embodiment according to the invention creates a computer program for performing said method when the computer program runs on a computer.

Another embodiment according to the invention creates an audio decoder for providing a decoded audio information on the basis of an encoded audio information. The audio decoder comprises an error concealment configured to provide an error concealment audio information for concealing a loss of an audio frame. The error concealment is configured to modify a time domain excitation signal obtained on the basis of one or more audio frames preceding a lost audio frame, in order to obtain the error concealment audio information.

This embodiment according to the invention is based on the idea that an error concealment with a good audio quality can be obtained on the basis of a time domain excitation signal, wherein a modification of the time domain excitation signal obtained on the basis of one or more audio frames preceding a lost audio frame allows for an adaptation of the error concealment audio information to expected (or predicted) changes of the audio content during the lost frame. Accordingly, artifacts and, in particular, an unnatural hearing impression, which would be caused by an unchanged usage of the time domain excitation signal, can be avoided.

Consequently, an improved provision of an error concealment audio information is achieved, such that lost audio frames can be concealed with improved results.

In an embodiment, the error concealment is configured to use one or more modified copies of the time domain excitation signal obtained for one or more audio frames preceding a lost audio frame, in order to obtain the error concealment information. By using one or more modified copies of the time domain excitation signal obtained for one or more audio frames preceding a lost audio frame, a good quality of the error concealment audio information can be achieved with little computational effort.

In an embodiment, the error concealment is configured to modify the time domain excitation signal obtained for one or more audio frames preceding a lost audio frame, or one or more copies thereof, to thereby reduce a periodic component of the error concealment audio information over time. By reducing the periodic component of the error concealment audio information over time, an unnaturally long preservation of a deterministic (for example, approximately periodic) sound can be avoided, which helps to make the error concealment audio information sound natural.

In an embodiment, the error concealment is configured to scale the time domain excitation signal obtained on the basis of one or more audio frames preceding the lost audio frame, or one or more copies thereof, to thereby modify the time domain excitation signal. The scaling of the time domain excitation signal constitutes a particularly efficient manner to vary the error concealment audio information over time.

In an embodiment, the error concealment is configured to gradually reduce a gain applied to scale the time domain excitation signal obtained for one or more audio frames preceding a lost audio frame, or the one or more copies thereof. It has been found that gradually reducing the gain applied to scale the time domain excitation signal obtained for one or more audio frames preceding a lost audio frame, or the one or more copies thereof, allows to obtain a time domain excitation signal for the provision of the error concealment audio information, such that the deterministic components (for example, at least approximately periodic components) are faded out. For example, there may be not only one gain. For example, we may have one gain for the tonal part (also referred to as approximately periodic part), and one gain for the noise part. Both excitations (or excitation components) may be attenuated separately with different speed factor and then the two resulting excitations (or excitation components) may be combined before being fed to the LPC for synthesis. In the case that we don't have any background noise estimate, the fade out factor for the noise and for the tonal part may be similar, and then we can have only one fade out apply on the results of the two excitations multiply with their own gain and combined together.

Thus, it can be avoided that the error concealment audio information comprises a temporally extended deterministic (for example, at least approximately periodic) audio component, which would typically provide an unnatural hearing impression.

In an embodiment, the error concealment is configured to adjust a speed used to gradually reduce a gain applied to scale the time domain excitation signal obtained for one or more audio frames preceding a lost audio frame, or the one or more copies thereof, in dependence on one or more parameters of one or more audio frames preceding the lost audio frame, and/or in dependence on a number of consecutive lost audio frames. Thus, the speed of the fade out of the deterministic (for example, at least approximately periodic) component in the error concealment audio information can be adapted to the specific situation with moderate computational effort. Since the time domain excitation signal used for the provision of the error concealment audio information is typically a scaled version (scaled using the gain mentioned above) of the time domain excitation signal obtained for the one or more audio frames preceding the lost audio frame, a variation of said gain (used to derive the time domain excitation signal for the provision of the error concealment audio information) constitutes a simple yet effective method to adapt the error concealment audio information to the specific needs. However, the speed of the fade out is also controllable with very little effort.

In an embodiment, the error concealment is configured to adjust the speed used to gradually reduce a gain applied to scale the time domain excitation signal obtained on the basis of one or more audio frames preceding a lost audio frame, or the one or more copies thereof, in dependence on a length of a pitch period of the time domain excitation signal, such that a time domain excitation signal input into an LPC synthesis is faded out faster for signals having a shorter length of the pitch period when compared to signals having a larger length of the pitch period. Accordingly, the fade out is performed faster for signals having a shorter length of the pitch period, which avoids that a pitch period is copied too many times (which would typically result in an unnatural hearing impression).

In an embodiment, the error concealment is configured to adjust the speed used to gradually reduce a gain applied to scale the time domain excitation signal obtained for one or more audio frames preceding a lost audio frame, or the one or more copies thereof, in dependence on a result of a pitch analysis or a pitch prediction, such that a deterministic component of a time domain excitation signal input into an LPC synthesis is faded out faster for signals having a larger pitch change per time unit when compared to signals having a smaller pitch change per time unit, and/or such that a deterministic component of a time domain excitation signal input into an LPC synthesis is faded out faster for signals for which a pitch prediction fails when compared to signals for which the pitch prediction succeeds. Accordingly, a deterministic (for example, at least approximately periodic) component is faded out faster for signals for which there is a larger uncertainty of the pitch (wherein a larger pitch change per time unit, or even a failure of the pitch prediction, indicates a comparatively large uncertainty of the pitch). Thus, artifacts, which would arise from a provision of a highly deterministic error concealment audio information in a situation in which the actual pitch is uncertain, can be avoided.

In an embodiment, the error concealment is configured to time-scale the time domain excitation signal obtained for (or on the basis of) one or more audio frames preceding a lost audio frame, or the one or more copies thereof, in dependence on a prediction of a pitch for the time of the one or more lost audio frames. Accordingly, the time domain excitation signal, which is used for the provision of the error concealment audio information, is modified (when compared to the time domain excitation signal obtained for (or on the basis of) one or more audio frames preceding a lost audio frame, such that the pitch of the time domain excitation signal follows the requirements of a time period of the lost audio frame. Consequently, a hearing impression, which can be achieved by the error concealment audio information, can be improved.

In an embodiment, the error concealment is configured to obtain a time domain excitation signal, which has been used to decode one or more audio frames preceding the lost audio frame, and to modify said time domain excitation signal, which has been used to decode one or more audio frames preceding the lost audio frame, to obtain a modified time domain excitation signal. In this case, the time domain concealment is configured to provide the error concealment audio information on the basis of the modified time domain audio signal. Accordingly, it is possible to reuse a time domain excitation signal, which has already been used to decode one or more audio frames preceding the lost audio frame. Thus, a computational effort can be kept very small, if the time domain excitation signal has already been acquired for the decoding of one or more audio frames preceding the lost audio frame.

In an embodiment, the error concealment is configured to obtain a pitch information, which has been used to decode one or more audio frames preceding the lost audio frame. In this case, the error concealment is also configured to provide the error concealment audio information in dependence on said pitch information. Accordingly, the previously used pitch information can be reused, which avoids a computational effort for a new computation of the pitch information. Thus, the error concealment is particularly computationally efficient. For example, in the case of ACELP we have 4 pitch lag and gains per frame. We may use the last two frames to be able to predict the pitch at the end of the frame we have to conceal.

Then compare to the previous described frequency domain codec where only one or two pitch per frame are derived (we could have more than two but that would add much complexity for not much gain in quality). in the case of a switch codec that goes for example, ACELP—FD—loss then, we have much better pitch precision since the pitch are transmitted in the bitstream and are based on the original input signal (not on the decoded one as done in the decoder). In the case of high bitrate, for example, we may also send one pitch lag and gain information, or LTP information, per frequency domain coded frame.

In an embodiment, the audio decoder the error concealment may be configured to obtain a pitch information on the basis of a side information of the encoded audio information.

In an embodiment, the error concealment may be configured to obtain a pitch information on the basis of a pitch information available for a previously decoded audio frame.

In an embodiment, the error concealment is configured to obtain a pitch information on the basis of a pitch search performed on a time domain signal or on a residual signal.

Worded differently, the pitch can be transmitted as side info or could also come from the previous frame if there is LTP for example. The pitch information could also be transmit in the bitstream if available at the encoder. We can do optionally the pitch search on the time domain signal directly or on the residual, that give usually better results on the residual (time domain excitation signal).

In an embodiment, the error concealment is configured to obtain a set of linear prediction coefficients, which have been used to decode one or more audio frames preceding the lost audio frame. In this case, the error concealment is configured to provide the error concealment audio information in dependence on said set of linear prediction coefficients. Thus, the efficiency of the error concealment is increased by reusing previously generated (or previously decoded) information, like for example the previously used set of linear prediction coefficients. Thus, unnecessarily high computational complexity is avoided.

In an embodiment, the error concealment is configured to extrapolate a new set of linear prediction coefficients on the basis of the set of linear prediction coefficients, which have been used to decode one or more audio frames preceding the lost audio frame. In this case, the error concealment is configured to use the new set of linear prediction coefficients to provide the error concealment information. By deriving the new set of linear prediction coefficients, used to provide the error concealment audio information, from a set of previously used linear prediction coefficients using an extrapolation, a full recalculation of the linear prediction coefficients can be avoided, which helps to keep the computational effort reasonably small. Moreover, by performing an extrapolation on the basis of the previously used set of linear prediction coefficients, it can be ensured that the new set of linear prediction coefficients is at least similar to the previously used set of linear prediction coefficients, which helps to avoid discontinuities when providing the error concealment information. For example, after a certain amount of frame loss we tend to a estimate background noise LPC shape. The speed of this convergence, may, for example, depend on the signal characteristic.

In an embodiment, the error concealment is configured to obtain an information about an intensity of a deterministic signal component in one or more audio frames preceding a lost audio frame. In this case, the error concealment is configured to compare the information about an intensity of a deterministic signal component in one or more audio frames preceding a lost audio frame with a threshold value, to decide whether to input a deterministic component of a time domain excitation signal into a LPC synthesis (linear-prediction-coefficient based synthesis), or whether to input only a noise component of a time domain excitation signal into the LPC synthesis. Accordingly, it is possible to omit the provision of a deterministic (for example, at least approximately periodic) component of the error concealment audio information in the case that there is only a small deterministic signal contribution within the one or more frames preceding the lost audio frame. It has been found that this helps to obtain a good hearing impression.

In an embodiment, the error concealment is configured to obtain a pitch information describing a pitch of the audio frame preceding the lost audio frame, and to provide the error concealment audio information in dependence on the pitch information. Accordingly, it is possible to adapt the pitch of the error concealment information to the pitch of the audio frame preceding the lost audio frame. Accordingly, discontinuities are avoided and a natural hearing impression can be achieved.

In an embodiment, the error concealment is configured to obtain the pitch information on the basis of the time domain excitation signal associated with the audio frame preceding the lost audio frame. It has been found that the pitch information obtained on the basis of the time domain excitation signal is particularly reliable, and is also very well adapted to the processing of the time domain excitation signal.

In an embodiment, the error concealment is configured to evaluate a cross correlation of the time domain excitation signal (or, alternatively, of a time domain audio signal), to determine a coarse pitch information, and to refine the coarse pitch information using a closed loop search around a pitch determined (or described) by the coarse pitch information. It has been found that this concept allows to obtain a very precise pitch information with moderate computational effort. In other words, in some codec we do the pitch search directly on the time domain signal whereas in some other we do the pitch search on the time domain excitation signal.

In an embodiment, the error concealment is configured to obtain the pitch information for the provision of the error concealment audio information on the basis of a previously computed pitch information, which was used for a decoding of one or more audio frames preceding the lost audio frame, and on the basis of an evaluation of a cross correlation of the time domain excitation signal, which is modified in order to obtain a modified time domain excitation signal for the provision of the error concealment audio information. It has been found that considering both the previously computed pitch information and the pitch information obtained on the basis of the time domain excitation signal (using a cross correlation) improves the reliability of the pitch information and consequently helps to avoid artifacts and/or discontinuities.

In an embodiment, the error concealment is configured to select a peak of the cross correlation, out of a plurality of peaks of the cross correlation, as a peak representing a pitch in dependence on the previously computed pitch information, such that a peak is chosen which represents a pitch that is closest to the pitch represented by the previously computed pitch information. Accordingly, possible ambiguities of the cross correlation, which may, for example, result in multiple peaks, can be overcome. The previously computed pitch information is thereby used to select the "proper" peak of the cross correlation, which helps to substantially increase the reliability. On the other hand, the actual time domain excitation signal is considered primarily for the pitch determination, which provides a good accuracy (which is substantially better than an accuracy obtainable on the basis of only the previously computed pitch information).

In an embodiment, the audio decoder the error concealment may be configured to obtain a pitch information on the basis of a side information of the encoded audio information.

In an embodiment, the error concealment may be configured to obtain a pitch information on the basis of a pitch information available for a previously decoded audio frame.

In an embodiment, the error concealment is configured to obtain a pitch information on the basis of a pitch search performed on a time domain signal or on a residual signal.

Worded differently, the pitch can be transmitted as side info or could also come from the previous frame if there is LTP for example. The pitch information could also be transmit in the bitstream if available at the encoder. We can do optionally the pitch search on the time domain signal directly or on the residual, that give usually better results on the residual (time domain excitation signal).

In an embodiment, the error concealment is configured to copy a pitch cycle of the time domain excitation signal associated with the audio frame preceding the lost audio frame one time or multiple times, in order to obtain an excitation signal (or at least a deterministic component thereof) for a synthesis of the error concealment audio information. By copying the pitch cycle of the time domain excitation signal associated with the audio frame preceding the lost audio frame one time or multiple times, and by modifying said one or more copies using a comparatively simple modification algorithm, the excitation signal (or at least the deterministic component thereof) for the synthesis of the error concealment audio information can be obtained with little computational effort. However, reusing the time domain excitation signal associated with the audio frame preceding the lost audio frame (by copying said time domain excitation signal) avoids audible discontinuities.

In an embodiment, the error concealment is configured to low-pass filter the pitch cycle of the time domain excitation signal associated with the audio frame preceding the lost audio frame using a sampling-rate dependent filter, a bandwidth of which is dependent on a sampling rate of the audio frame encoded in a frequency domain representation. Accordingly, the time domain excitation signal is adapted to a signal bandwidth of the audio decoder, which results in a good reproduction of the audio content. For details and optional improvements, reference is made, for example, to the above explanations.

For example, it is advantageous to low pass only on the first lost frame, and we also low pass only if the signal is not unnoticed. However, it should be noted that the low-pass-filtering is optional. Furthermore the filter may be sampling-rate dependent, such that the cut-off frequency is independent of the bandwidth.

In an embodiment, the error concealment is configured to predict a pitch at an end of a lost frame. In this case, error concealment is configured to adapt the time domain excitation signal, or one or more copies thereof, to the predicted pitch. By modifying the time domain excitation signal, such that the time domain excitation signal which is actually used for the provision of the error concealment audio information is modified with respect to the time domain excitation signal associated with an audio frame preceding the lost audio frame, expected (or predicted) pitch changes during the lost audio frame can be considered, such that the error concealment audio information is well-adapted to the actual evolution (or at least to the expected or predicted evolution) of the audio content. For example, the adaptation is going from the last good pitch to the predicted one. That is done by the pulse resynchronization [7]

In an embodiment, the error concealment is configured to combine an extrapolated time domain excitation signal and a noise signal, in order to obtain an input signal for an LPC synthesis. In this case, the error concealment is configured to perform the LPC synthesis, wherein the LPC synthesis is configured to filter the input signal of the LPC synthesis in dependence on linear-prediction-coding parameters, in order to obtain the error concealment audio information. By combining the extrapolated time domain excitation signal (which is typically a modified version of the time domain excitation signal derived for one or more audio frames preceding the lost audio frame) and a noise signal, both deterministic (for example, approximately periodic) components and noise components of the audio content can be considered in the error concealment. Thus, it can be achieved that the error concealment audio information provides a hearing impression which is similar to the hearing impression provided by the frames preceding the lost frame.

Also, by combining a time domain excitation signal and a noise signal, in order to obtain the input signal for the LPC synthesis (which may be considered as a combined time domain excitation signal), it is possible to vary a percentage of the deterministic component of the input audio signal for the LPC synthesis while maintaining an energy (of the input signal of the LPC synthesis, or even of the output signal of the LPC synthesis). Consequently, it is possible to vary the characteristics of the error concealment audio information (for example, tonality characteristics) without substantially changing an energy or loudness of the error concealment audio signal, such that it is possible to modify the time domain excitation signal without causing unacceptable audible distortions.

An embodiment according to the invention creates a method for providing a decoded audio information on the basis of an encoded audio information. The method comprises providing an error concealment audio information for concealing a loss of an audio frame. Providing the error concealment audio information comprises modifying a time domain excitation signal obtained on the basis of one or more audio frames preceding a lost audio frame, in order to obtain the error concealment audio information.

This method is based on the same considerations the above described audio decoder.

A further embodiment according to the invention creates a computer program for performing said method when the computer program runs on a computer.

BRIEF DESCRIPTION OF THE DRAWINGS

Embodiments of the present invention will be detailed subsequently referring to the appended drawings, in which.

DETAILED DESCRIPTION OF THE INVENTION

1. Audio Decoder According to FIG. 1

Figure 1:
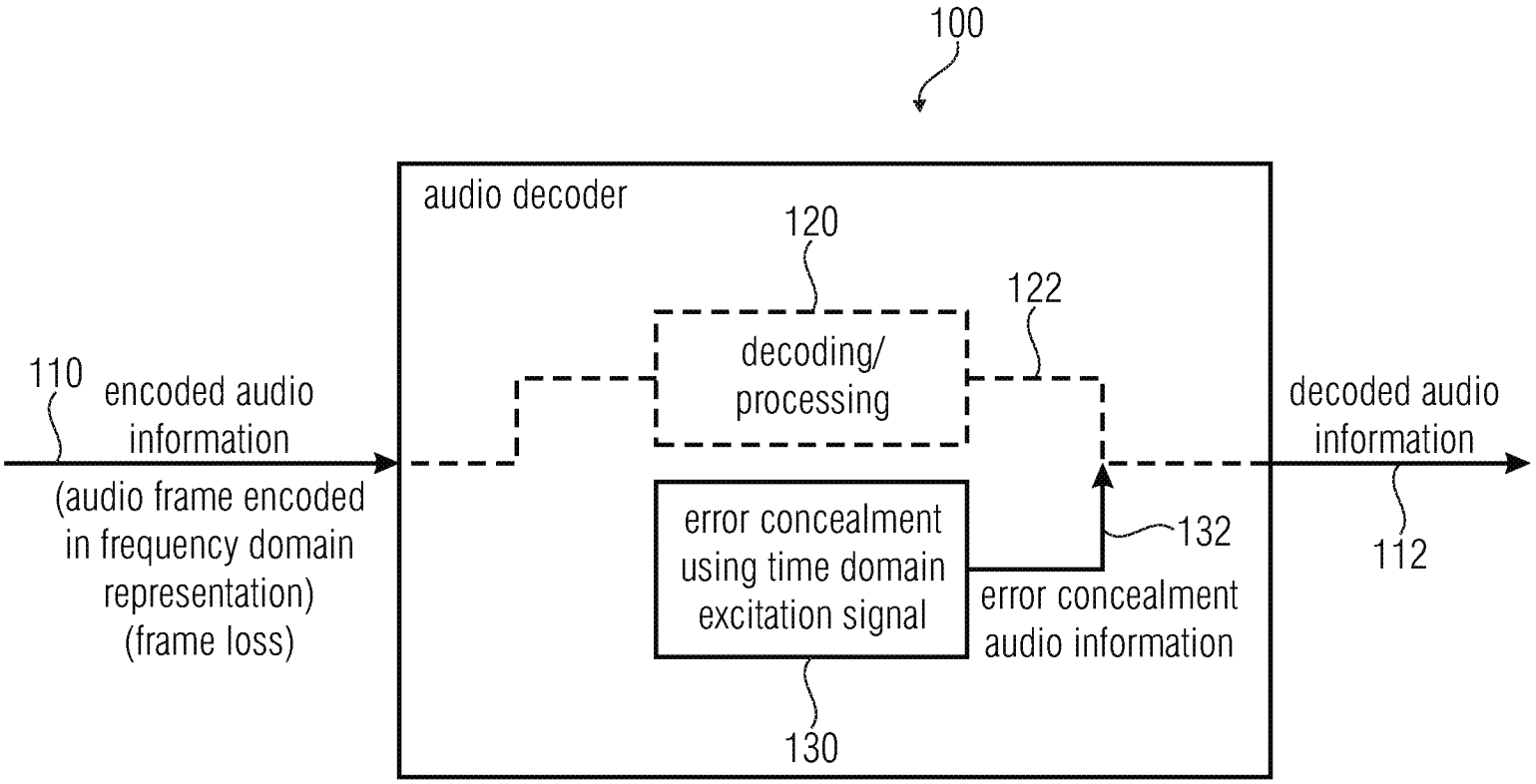
FIG. 1 shows a block schematic diagram of an audio decoder, according to an embodiment of the invention.

FIG. 1 shows a block schematic diagram of an audio decoder 100, according to an embodiment of the present invention. The audio decoder 100 receives an encoded audio information 110, which may, for example, comprise an audio frame encoded in a frequency-domain representation. The encoded audio information may, for example, be received via an unreliable channel, such that a frame loss occurs from time to time. The audio decoder 100 further provides, on the basis of the encoded audio information 110, the decoded audio information 112.

The audio decoder 100 may comprise a decoding/processing 120, which provides the decoded audio information on the basis of the encoded audio information in the absence of a frame loss.

The audio decoder 100 further comprises an error concealment 130, which provides an error concealment audio information. The error concealment 130 is configured to provide the error concealment audio information 132 for concealing a loss of an audio frame following an audio frame encoded in the frequency domain representation, using a time domain excitation signal.

In other words, the decoding/processing 120 may provide a decoded audio information 122 for audio frames which are encoded in the form of a frequency domain representation, i.e. in the form of an encoded representation, encoded values of which describe intensities in different frequency bins. Worded differently, the decoding/processing 120 may, for example, comprise a frequency domain audio decoder, which derives a set of spectral values from the encoded audio information 110 and performs a frequency-domain-to-time-domain transform to thereby derive a time domain representation which constitutes the decoded audio information 122 or which forms the basis for the provision of the decoded audio information 122 in case there is additional post processing.

However, the error concealment 130 does not perform the error concealment in the frequency domain but rather uses a time domain excitation signal, which may, for example, serve to excite a synthesis filter, like for example a LPC synthesis filter, which provides a time domain representation of an audio signal (for example, the error concealment audio information) on the basis of the time domain excitation signal and also on the basis of LPC filter coefficients (linear-prediction-coding filter coefficients).

Accordingly, the error concealment 130 provides the error concealment audio information 132, which may, for example, be a time domain audio signal, for lost audio frames, wherein the time domain excitation signal used by the error concealment 130 may be based on, or derived from, one or more previous, properly received audio frames (preceding the lost audio frame), which are encoded in the form of a frequency domain representation. To conclude, the audio decoder 100 may perform an error concealment (i.e. provide an error concealment audio information 132), which reduces a degradation of an audio quality due to the loss of an audio frame on the basis of an encoded audio information, in which at least some audio frames are encoded in a frequency domain representation. It has been found that performing the error concealment using a time domain excitation signal even if a frame following a properly received audio frame encoded in the frequency domain representation is lost, brings along an improved audio quality when compared to an error concealment which is performed in the frequency domain (for example, using a frequency domain representation of the audio frame encoded in the frequency domain representation preceding the lost audio frame). This is due to the fact that a smooth transition between the decoded audio information associated with the properly received audio frame preceding the lost audio frame and the error concealment audio information associated with the lost audio frame can be achieved using a time domain excitation signal, since the signal synthesis, which is typically performed on the basis of the time domain excitation signal, helps to avoid discontinuities. Thus, a good (or at least acceptable) hearing impression can be achieved using the audio decoder 100, even if an audio frame is lost which follows a properly received audio frame encoded in the frequency domain representation. For example, the time domain approach brings improvement on monophonic signal, like speech, because it is closer to what is done in case of speech codec concealment. The usage of LPC helps to avoid discontinuities and give a better shaping of the frames.

Moreover, it should be noted that the audio decoder 100 can be supplemented by any of the features and functionalities described in the following, either individually or taken in combination.

2. Audio Decoder According to FIG. 2

Figure 2:
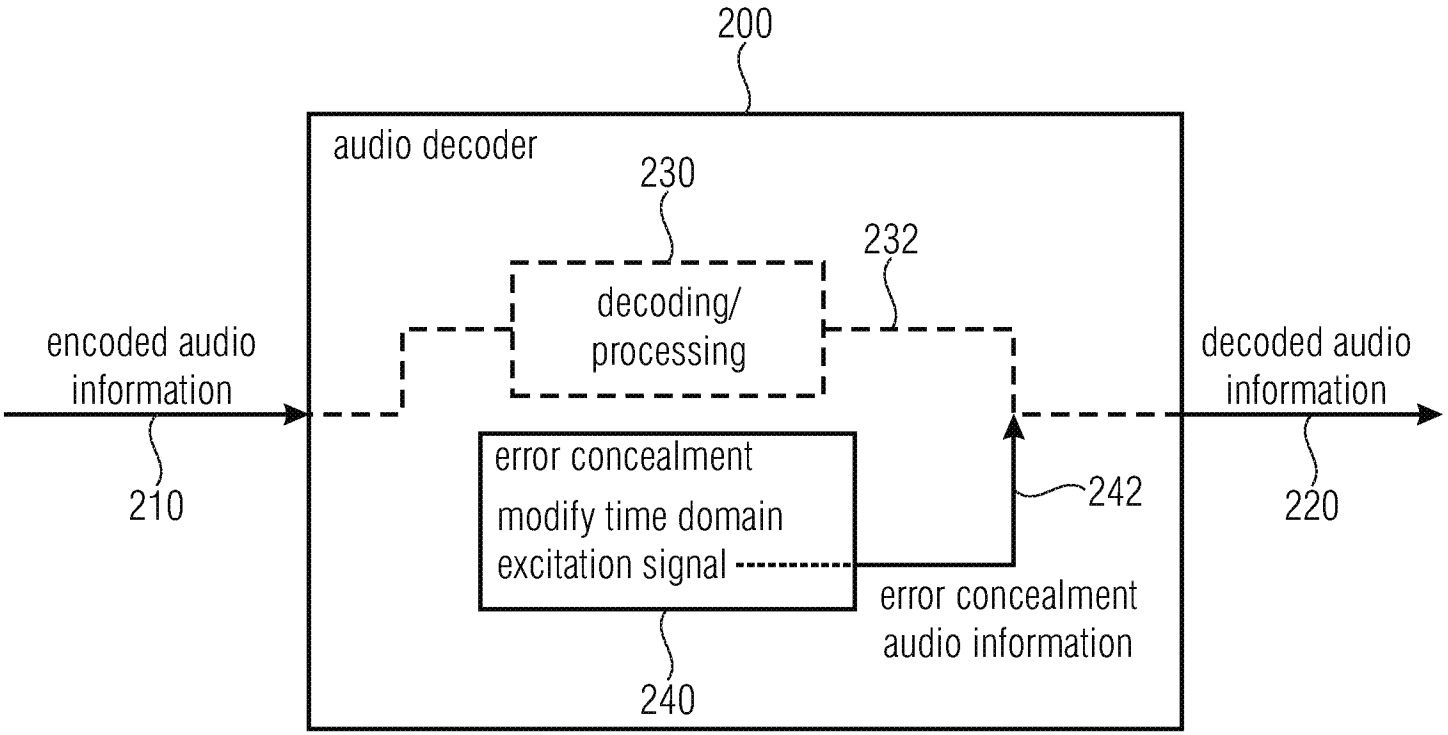
FIG. 2 shows a block schematic diagram of an audio decoder, according to another embodiment of the present invention.

FIG. 2 shows a block schematic diagram of an audio decoder 200 according to an embodiment of the present invention. The audio decoder 200 is configured to receive an encoded audio information 210 and to provide, on the basis thereof, a decoded audio information 220. The encoded audio information 210 may, for example, take the form of a sequence of audio frames encoded in a time domain representation, encoded in a frequency domain representation, or encoded in both a time domain representation and a frequency domain representation. Worded differently, all of the frames of the encoded audio information 210 may be encoded in a frequency domain representation, or all of the frames of the encoded audio information 210 may be encoded in a time domain representation (for example, in the form of an encoded time domain excitation signal and encoded signal synthesis parameters, like, for example, LPC parameters). Alternatively, some frames of the encoded audio information may be encoded in a frequency domain representation, and some other frames of the encoded audio information may be encoded in a time domain representation, for example, if the audio decoder 200 is a switching audio decoder which can switch between different decoding modes. The decoded audio information 220 may, for example, be a time domain representation of one or more audio channels.

The audio decoder 200 may typically comprise a decoding/processing 220, which may, for example, provide a decoded audio information 232 for audio frames which are properly received. In other words, the decoding/processing 230 may perform a frequency domain decoding (for example, an AAC-type decoding, or the like) on the basis of one or more encoded audio frames encoded in a frequency domain representation. Alternatively, or in addition, the decoding/processing 230 may be configured to perform a time domain decoding (or linear-prediction-domain decoding) on the basis of one or more encoded audio frames encoded in a time domain representation (or, in other words, in a linear-prediction-domain representation), like, for example, a TCX-excited linear-prediction decoding (TCX=transform-coded excitation) or an ACELP decoding (algebraic-codebook-excited-linear-prediction-decoding). Optionally, the decoding/processing 230 may be configured to switch between different decoding modes.

The audio decoder 200 further comprises an error concealment 240, which is configured to provide an error concealment audio information 242 for one or more lost audio frames. The error concealment 240 is configured to provide the error concealment audio information 242 for concealing a loss of an audio frame (or even a loss of multiple audio frames). The error concealment 240 is configured to modify a time domain excitation signal obtained on the basis of one or more audio frames preceding a lost audio frame, in order to obtain the error concealment audio information 242. Worded differently, the error concealment 240 may obtain (or derive) a time domain excitation signal for (or on the basis of) one or more encoded audio frames preceding a lost audio frame, and may modify said time domain excitation signal, which is obtained for (or on the basis of) one or more properly received audio frames preceding a lost audio frame, to thereby obtain (by the modification) a time domain excitation signal which is used for providing the error concealment audio information 242. In other words, the modified time domain excitation signal may be used as an input (or as a component of an input) for a synthesis (for example, LPC synthesis) of the error concealment audio information associated with the lost audio frame (or even with multiple lost audio frames). By providing the error concealment audio information 242 on the basis of the time domain excitation signal obtained on the basis of one or more properly received audio frames preceding the lost audio frame, audible discontinuities can be avoided. On the other hand, by modifying the time domain excitation signal derived for (or from) one or more audio frames preceding the lost audio frame, and by providing the error concealment audio information on the basis of the modified time domain excitation signal, it is possible to consider varying characteristics of the audio content (for example, a pitch change), and it is also possible to avoid an unnatural hearing impression (for example, by "fading out" a deterministic (for example, at least approximately periodic) signal component). Thus, it can be achieved that the error concealment audio information 242 comprises some similarity with the decoded audio information 232 obtained on the basis of properly decoded audio frames preceding the lost audio frame, and it can still be achieved that the error concealment audio information 242 comprises a somewhat different audio content when compared to the decoded audio information 232 associated with the audio frame preceding the lost audio frame by somewhat modifying the time domain excitation signal. The modification of the time domain excitation signal used for the provision of the error concealment audio information (associated with the lost audio frame) may, for example, comprise an amplitude scaling or a time scaling. However, other types of modification (or even a combination of an amplitude scaling and a time scaling) are possible, wherein a certain degree of relationship between the time domain excitation signal obtained (as an input information) by the error concealment and the modified time domain excitation signal should remain.

To conclude, the audio decoder 200 allows to provide the error concealment audio information 242, such that the error concealment audio information provides for a good hearing impression even in the case that one or more audio frames are lost. The error concealment is performed on the basis of a time domain excitation signal, wherein a variation of the signal characteristics of the audio content during the lost audio frame is considered by modifying the time domain excitation signal obtained on the basis of the one more audio frames preceding a lost audio frame.

Moreover, it should be noted that the audio decoder 200 can be supplemented by any of the features and functionalities described herein, either individually or in combination.

3. Audio Decoder According to FIG. 3

Figure 3:
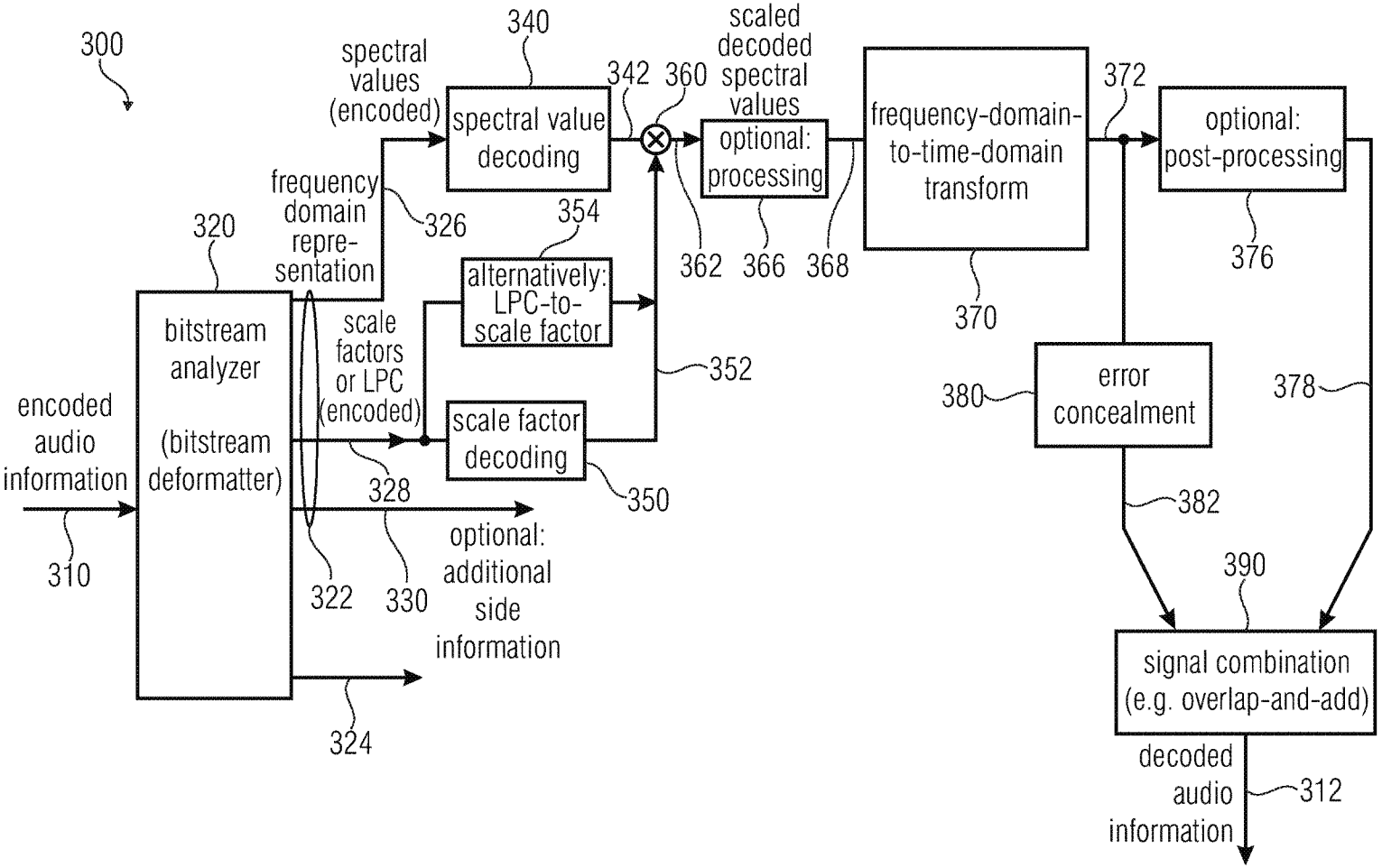
FIG. 3 shows a block schematic diagram of an audio decoder, according to another embodiment of the present invention.

FIG. 3 shows a block schematic diagram of an audio decoder 300, according to another embodiment of the present invention.

The audio decoder 300 is configured to receive an encoded audio information 310 and to provide, on the basis thereof, a decoded audio information 312. The audio decoder 300 comprises a bitstream analyzer 320, which may also be designated as a "bitstream deformatter" or "bitstream parser". The bitstream analyzer 320 receives the encoded audio information 310 and provides, on the basis thereof, a frequency domain representation 322 and possibly additional control information 324. The frequency domain representation 322 may, for example, comprise encoded spectral values 326, encoded scale factors 328 and, optionally, an additional side information 330 which may, for example, control specific processing steps, like, for example, a noise filling, an intermediate processing or a post-processing. The audio decoder 300 also comprises a spectral value decoding 340 which is configured to receive the encoded spectral values 326, and to provide, on the basis thereof, a set of decoded spectral values 342. The audio decoder 300 may also comprise a scale factor decoding 350, which may be configured to receive the encoded scale factors 328 and to provide, on the basis thereof, a set of decoded scale factors 352.

Alternatively to the scale factor decoding, an LPC-to-scale factor conversion 354 may be used, for example, in the case that the encoded audio information comprises an encoded LPC information, rather than an scale factor information. However, in some coding modes (for example, in the TCX decoding mode of the USAC audio decoder or in the EVS audio decoder) a set of LPC coefficients may be used to derive a set of scale factors at the side of the audio decoder. This functionality may be reached by the LPC-to-scale factor conversion 354.

The audio decoder 300 may also comprise a scaler 360, which may be configured to apply the set of scaled factors 352 to the set of spectral values 342, to thereby obtain a set of scaled decoded spectral values 362. For example, a first frequency band comprising multiple decoded spectral values 342 may be scaled using a first scale factor, and a second frequency band comprising multiple decoded spectral values 342 may be scaled using a second scale factor. Accordingly, the set of scaled decoded spectral values 362 is obtained. The audio decoder 300 may further comprise an optional processing 366, which may apply some processing to the scaled decoded spectral values 362. For example, the optional processing 366 may comprise a noise filling or some other operations.

The audio decoder 300 also comprises a frequency-domain-to-time-domain transform 370, which is configured to receive the scaled decoded spectral values 362, or a processed version 368 thereof, and to provide a time domain representation 372 associated with a set of scaled decoded spectral values 362. For example, the frequency-domain-to-time domain transform 370 may provide a time domain representation 372, which is associated with a frame or sub-frame of the audio content. For example, the frequency-domain-to-time-domain transform may receive a set of MDCT coefficients (which can be considered as scaled decoded spectral values) and provide, on the basis thereof, a block of time domain samples, which may form the time domain representation 372.

The audio decoder 300 may optionally comprise a post-processing 376, which may receive the time domain representation 372 and somewhat modify the time domain representation 372, to thereby obtain a post-processed version 378 of the time domain representation 372.

The audio decoder 300 also comprises an error concealment 380 which may, for example, receive the time domain representation 372 from the frequency-domain-to-time-domain transform 370 and which may, for example, provide an error concealment audio information 382 for one or more lost audio frames. In other words, if an audio frame is lost, such that, for example, no encoded spectral values 326 are available for said audio frame (or audio sub-frame), the error concealment 380 may provide the error concealment audio information on the basis of the time domain representation 372 associated with one or more audio frames preceding the lost audio frame. The error concealment audio information may typically be a time domain representation of an audio content.

It should be noted that the error concealment 380 may, for example, perform the functionality of the error concealment 130 described above. Also, the error concealment 380 may, for example, comprise the functionality of the error concealment 500 described taking reference to FIG. 5. However, generally speaking, the error concealment 380 may comprise any of the features and functionalities described with respect to the error concealment herein.

Regarding the error concealment, it should be noted that the error concealment does not happen at the same time of the frame decoding. For example if the frame n is good then we do a normal decoding, and at the end we save some variable that will help if we have to conceal the next frame, then if n+1 is lost we call the concealment function giving the variable coming from the previous good frame. We will also update some variables to help for the next frame loss or on the recovery to the next good frame.

The audio decoder 300 also comprises a signal combination 390, which is configured to receive the time domain representation 372 (or the post-processed time domain representation 378 in case that there is a post-processing 376). Moreover, the signal combination 390 may receive the error concealment audio information 382, which is typically also a time domain representation of an error concealment audio signal provided for a lost audio frame. The signal combination 390 may, for example, combine time domain representations associated with subsequent audio frames. In the case that there are subsequent properly decoded audio frames, the signal combination 390 may combine (for example, overlap-and-add) time domain representations associated with these subsequent properly decoded audio frames. However, if an audio frame is lost, the signal combination 390 may combine (for example, overlap-and-add) the time domain representation associated with the properly decoded audio frame preceding the lost audio frame and the error concealment audio information associated with the lost audio frame, to thereby have a smooth transition between the properly received audio frame and the lost audio frame. Similarly, the signal combination 390 may be configured to combine (for example, overlap-and-add) the error concealment audio information associated with the lost audio frame and the time domain representation associated with another properly decoded audio frame following the lost audio frame (or another error concealment audio information associated with another lost audio frame in case that multiple consecutive audio frames are lost).

Accordingly, the signal combination 390 may provide a decoded audio information 312, such that the time domain representation 372, or a post processed version 378 thereof, is provided for properly decoded audio frames, and such that the error concealment audio information 382 is provided for lost audio frames, wherein an overlap-and-add operation is typically performed between the audio information (irrespective of whether it is provided by the frequency-domain-to-time-domain transform 370 or by the error concealment 380) of subsequent audio frames. Since some codecs have some aliasing on the overlap and add part that need to be canceled, optionally we can create some artificial aliasing on the half a frame that we have created to perform the overlap add.

It should be noted that the functionality of the audio decoder 300 is similar to the functionality of the audio decoder 100 according to FIG. 1, wherein additional details are shown in FIG. 3. Moreover, it should be noted that the audio decoder 300 according to FIG. 3 can be supplemented by any of the features and functionalities described herein. In particular, the error concealment 380 can be supplemented by any of the features and functionalities described herein with respect to the error concealment.

4. Audio Decoder 400 According to FIG. 4

Figure 4A:
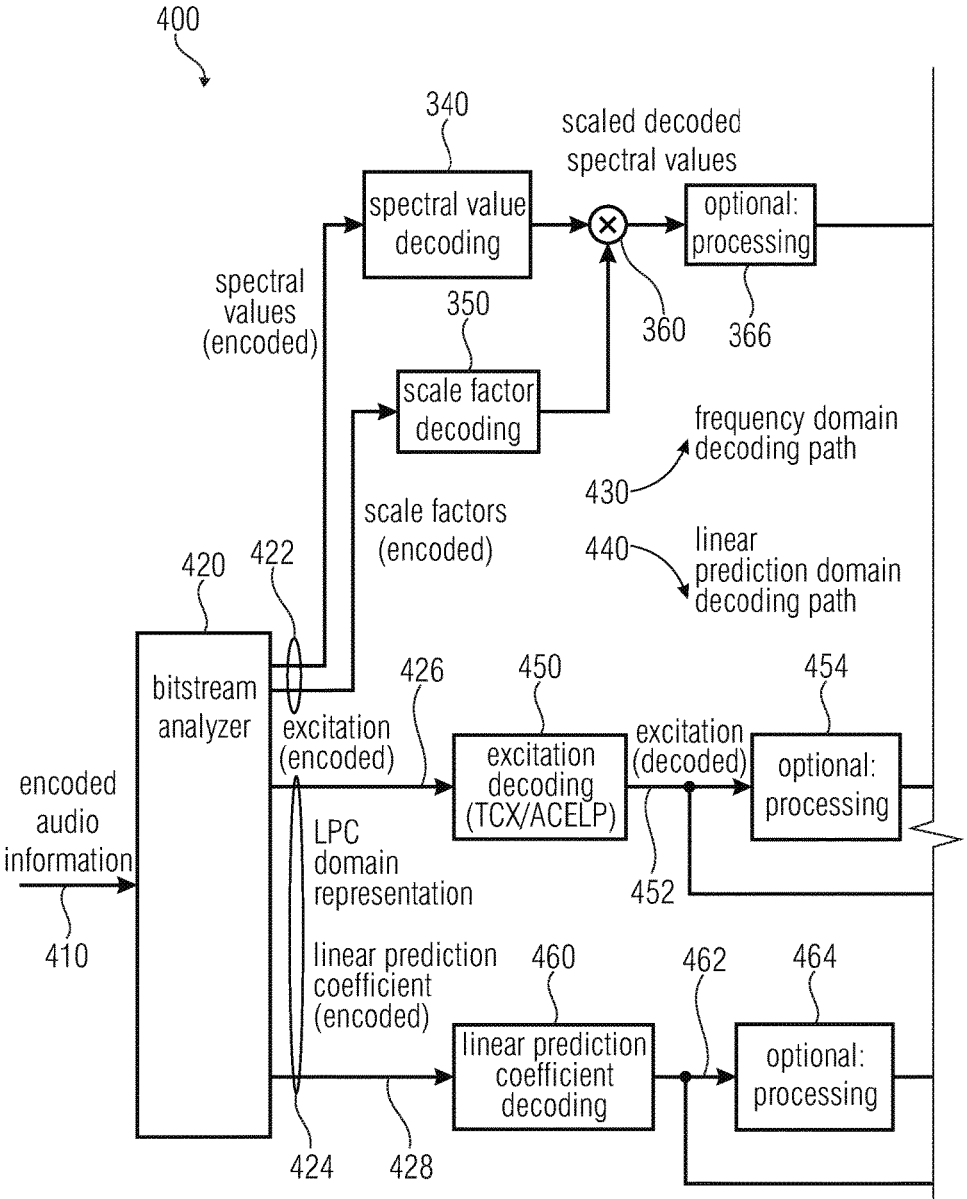
FIG. 4 shown in FIGS. 4A and 4B, shows a block schematic diagram of an audio decoder, according to another embodiment of the present invention.
Figure 4B:
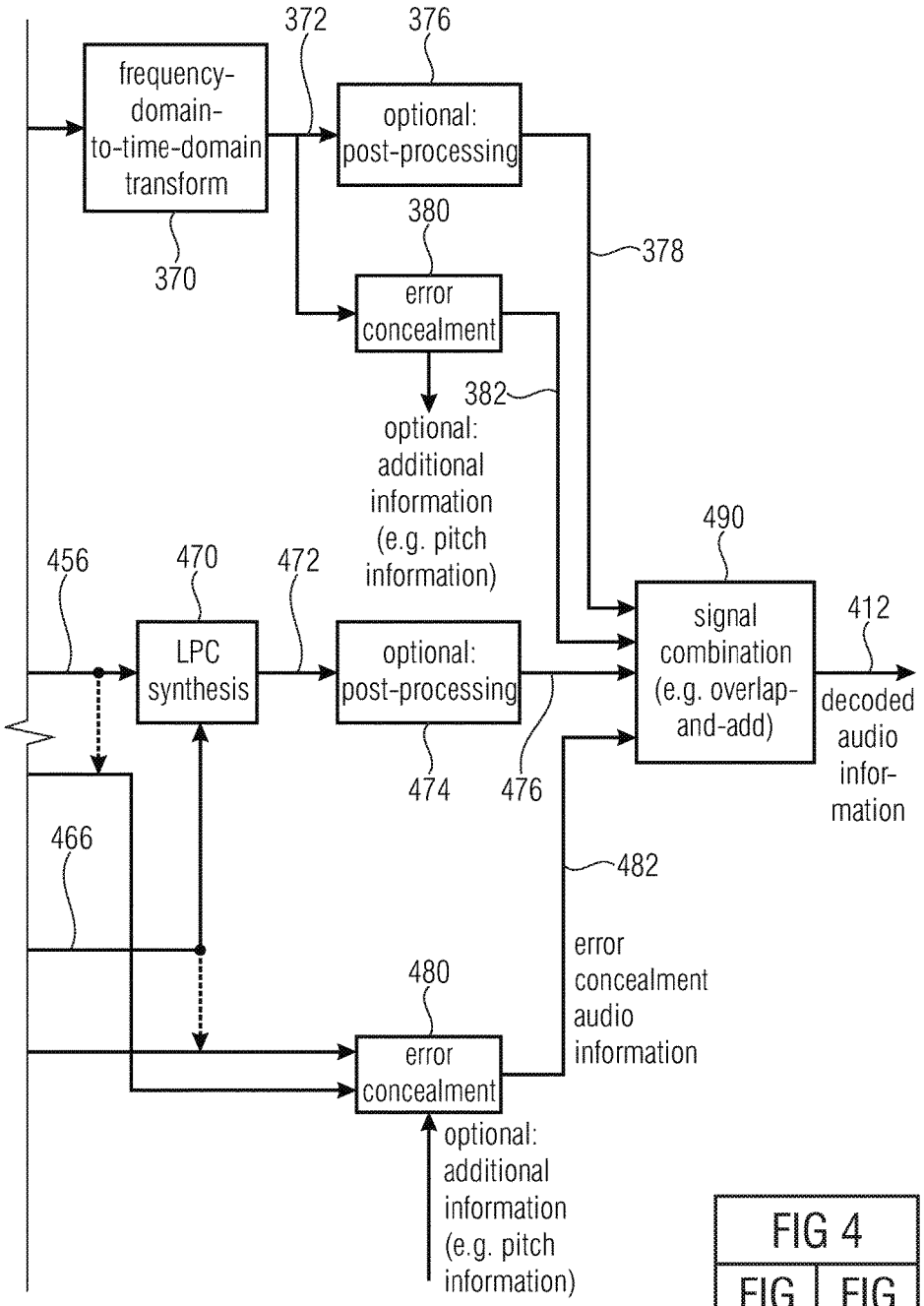

FIG. 4 (shown in FIGS. 4A and 4B) shows an audio decoder 400 according to another embodiment of the present invention. The audio decoder 400 is configured to receive an encoded audio information and to provide, on the basis thereof, a decoded audio information 412. The audio decoder 400 may, for example, be configured to receive an encoded audio information 410, wherein different audio frames are encoded using different encoding modes. For example, the audio decoder 400 may be considered as a multi-mode audio decoder or a "switching" audio decoder. For example, some of the audio frames may be encoded using a frequency domain representation, wherein the encoded audio information comprises an encoded representation of spectral values (for example, FFT values or MDCT values) and scale factors representing a scaling of different frequency bands. Moreover, the encoded audio information 410 may also comprise a "time domain representation" of audio frames, or a "linear-prediction-coding domain representation" of multiple audio frames. The "linear-prediction-coding domain representation" (also briefly designated as "LPC representation") may, for example, comprise an encoded representation of an excitation signal, and an encoded representation of LPC parameters (linear-prediction-coding parameters), wherein the linear-prediction-coding parameters describe, for example, a linear-prediction-coding synthesis filter, which is used to reconstruct an audio signal on the basis of the time domain excitation signal.

In the following, some details of the audio decoder 400 will be described.

The audio decoder 400 comprises a bitstream analyzer 420 which may, for example, analyze the encoded audio information 410 and extract, from the encoded audio information 410, a frequency domain representation 422, comprising, for example, encoded spectral values, encoded scale factors and, optionally, an additional side information. The bitstream analyzer 420 may also be configured to extract a linear-prediction coding domain representation 424, which may, for example, comprise an encoded excitation 426 and encoded linear-prediction-coefficients 428 (which may also be considered as encoded linear-prediction parameters). Moreover, the bitstream analyzer may optionally extract additional side information, which may be used for controlling additional processing steps, from the encoded audio information.

The audio decoder 400 comprises a frequency domain decoding path 430, which may, for example, be substantially identical to the decoding path of the audio decoder 300 according to FIG. 3. In other words, the frequency domain decoding path 430 may comprise a spectral value decoding 340, a scale factor decoding 350, a scaler 360, an optional processing 366, a frequency-domain-to-time-domain transform 370, an optional post-processing 376 and an error concealment 380 as described above with reference to FIG. 3.

The audio decoder 400 may also comprise a linear-prediction-domain decoding path 440 (which may also be considered as a time domain decoding path, since the LPC synthesis is performed in the time domain). The linear-prediction-domain decoding path comprises an excitation decoding 450, which receives the encoded excitation 426 provided by the bitstream analyzer 420 and provides, on the basis thereof, a decoded excitation 452 (which may take the form of a decoded time domain excitation signal). For example, the excitation decoding 450 may receive an encoded transform-coded-excitation information, and may provide, on the basis thereof, a decoded time domain excitation signal. Thus, the excitation decoding 450 may, for example, perform a functionality which is performed by the excitation decoder 730 described taking reference to FIG. 7. However, alternatively or in addition, the excitation decoding 450 may receive an encoded ACELP excitation, and may provide the decoded time domain excitation signal 452 on the basis of said encoded ACELP excitation information.

It should be noted that there different options for the excitation decoding. Reference is made, for example, to the relevant Standards and publications defining the CELP coding concepts, the ACELP coding concepts, modifications of the CELP coding concepts and of the ACELP coding concepts and the TCX coding concept.

The linear-prediction-domain decoding path 440 optionally comprises a processing 454 in which a processed time domain excitation signal 456 is derived from the time domain excitation signal 452.

The linear-prediction-domain decoding path 440 also comprises a linear-prediction coefficient decoding 460, which is configured to receive encoded linear prediction coefficients and to provide, on the basis thereof, decoded linear prediction coefficients 462.

The linear-prediction coefficient decoding 460 may use different representations of a linear prediction coefficient as an input information 428 and may provide different representations of the decoded linear prediction coefficients as the output information 462. For details, reference to made to different Standard documents in which an encoding and/or decoding of linear prediction coefficients is described.

The linear-prediction-domain decoding path 440 optionally comprises a processing 464, which may process the decoded linear prediction coefficients and provide a processed version 466 thereof.

The linear-prediction-domain decoding path 440 also comprises a LPC synthesis (linear-prediction coding synthesis) 470, which is configured to receive the decoded excitation 452, or the processed version 456 thereof, and the decoded linear prediction coefficients 462, or the processed version 466 thereof, and to provide a decoded time domain audio signal 472. For example, the LPC synthesis 470 may be configured to apply a filtering, which is defined by the decoded linear-prediction coefficients 462 (or the processed version 466 thereof) to the decoded time domain excitation signal 452, or the processed version thereof, such that the decoded time domain audio signal 472 is obtained by filtering (synthesis-filtering) the time domain excitation signal 452 (or 456). The linear prediction domain decoding path 440 may optionally comprise a post-processing 474, which may be used to refine or adjust characteristics of the decoded time domain audio signal 472.

The linear-prediction-domain decoding path 440 also comprises an error concealment 480, which is configured to receive the decoded linear prediction coefficients 462 (or the processed version 466 thereof) and the decoded time domain excitation signal 452 (or the processed version 456 thereof). The error concealment 480 may optionally receive additional information, like for example a pitch information. The error concealment 480 may consequently provide an error concealment audio information, which may be in the form of a time domain audio signal, in case that a frame (or sub-frame) of the encoded audio information 410 is lost. Thus, the error concealment 480 may provide the error concealment audio information 482 such that the characteristics of the error concealment audio information 482 are substantially adapted to the characteristics of a last properly decoded audio frame preceding the lost audio frame. It should be noted that the error concealment 480 may comprise any of the features and functionalities described with respect to the error concealment 240. In addition, it should be noted that the error concealment 480 may also comprise any of the features and functionalities described with respect to the time domain concealment of FIG. 6.

The audio decoder 400 also comprises a signal combiner (or signal combination 490), which is configured to receive the decoded time domain audio signal 372 (or the post-processed version 378 thereof), the error concealment audio information 382 provided by the error concealment 380, the decoded time domain audio signal 472 (or the post-processed version 476 thereof) and the error concealment audio information 482 provided by the error concealment 480. The signal combiner 490 may be configured to combine said signals 372 (or 378), 382, 472 (or 476) and 482 to thereby obtain the decoded audio information 412. In particular, an overlap-and-add operation may be applied by the signal combiner 490. Accordingly, the signal combiner 490 may provide smooth transitions between subsequent audio frames for which the time domain audio signal is provided by different entities (for example, by different decoding paths 430, 440). However, the signal combiner 490 may also provide for smooth transitions if the time domain audio signal is provided by the same entity (for example, frequency domain-to-time-domain transform 370 or LPC synthesis 470) for subsequent frames. Since some codecs have some aliasing on the overlap and add part that need to be canceled, optionally we can create some artificial aliasing on the half a frame that we have created to perform the overlap add. In other words, an artificial time domain aliasing compensation (TDAC) may optionally be used.

Also, the signal combiner 490 may provide smooth transitions to and from frames for which an error concealment audio information (which is typically also a time domain audio signal) is provided.

To summarize, the audio decoder 400 allows to decode audio frames which are encoded in the frequency domain and audio frames which are encoded in the linear prediction domain. In particular, it is possible to switch between a usage of the frequency domain decoding path and a usage of the linear prediction domain decoding path in dependence on the signal characteristics (for example, using a signaling information provided by an audio encoder).

Different types of error concealment may be used for providing an error concealment audio information in the case of a frame loss, depending on whether a last properly decoded audio frame was encoded in the frequency domain (or, equivalently, in a frequency-domain representation), or in the time domain (or equivalently, in a time domain representation, or, equivalently, in a linear-prediction domain, or, equivalently, in a linear-prediction domain representation).

5. Time Domain Concealment According to FIG. 5

Figure 5:
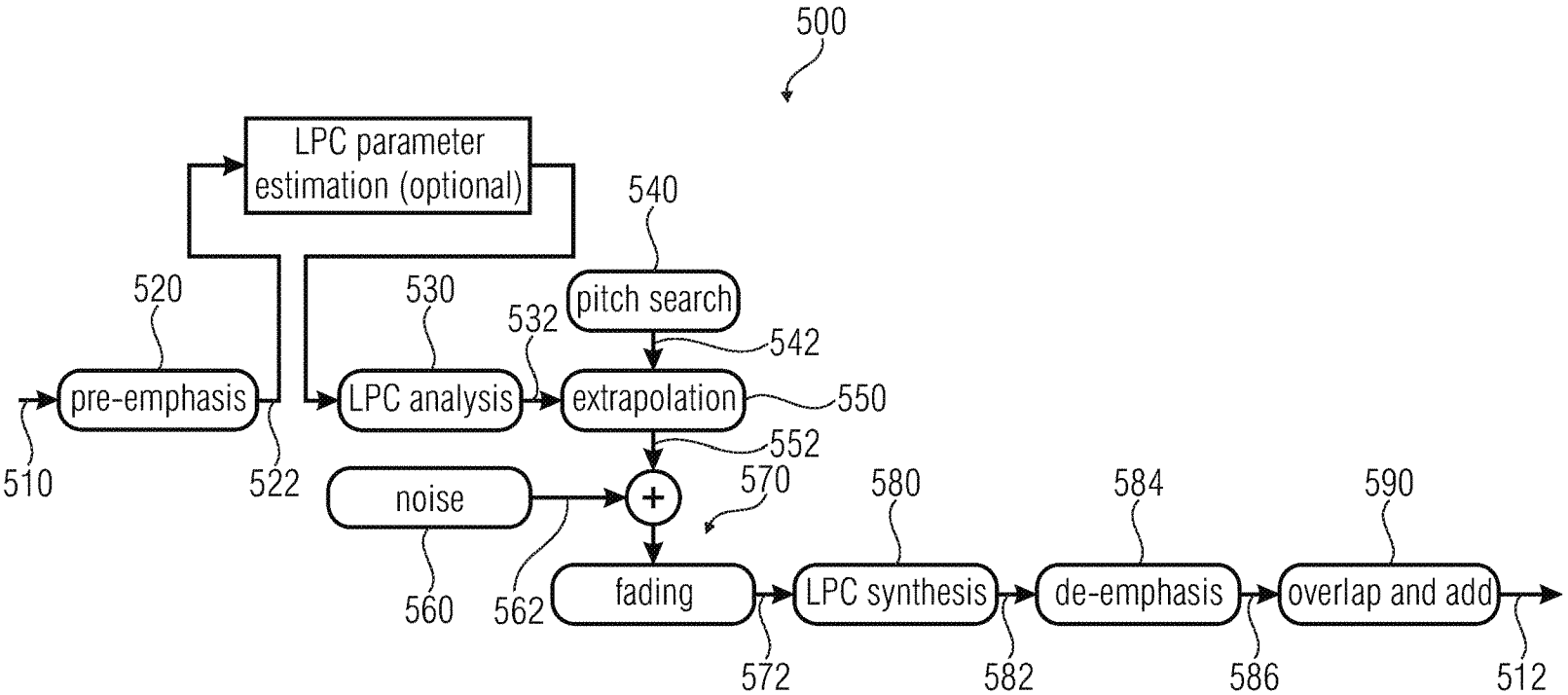
FIG. 5 shows a block schematic diagram of a time domain concealment for a transform coder.

FIG. 5 shows a block schematic diagram of an error concealment according to an embodiment of the present invention. The error concealment according to FIG. 5 is designated in its entirety as 500.

The error concealment 500 is configured to receive a time domain audio signal 510 and to provide, on the basis thereof, an error concealment audio information 512, which may, for example, take the form of a time domain audio signal.

It should be noted that the error concealment 500 may, for example, take the place of the error concealment 130, such that the error concealment audio information 512 may correspond to the error concealment audio information 132. Moreover, it should be noted that the error concealment 500 may take the place of the error concealment 380, such that the time domain audio signal 510 may correspond to the time domain audio signal 372 (or to the time domain audio signal 378), and such that the error concealment audio information 512 may correspond to the error concealment audio information 382.

The error concealment 500 comprises a pre-emphasis 520, which may be considered as optional. The pre-emphasis receives the time domain audio signal and provides, on the basis thereof, a pre-emphasized time domain audio signal 522.

The error concealment 500 also comprises a LPC analysis 530, which is configured to receive the time domain audio signal 510, or the pre-emphasized version 522 thereof, and to obtain an LPC information 532, which may comprise a set of LPC parameters 532. For example, the LPC information may comprise a set of LPC filter coefficients (or a representation thereof) and a time domain excitation signal (which is adapted for an excitation of an LPC synthesis filter configured in accordance with the LPC filter coefficients, to reconstruct, at least approximately, the input signal of the LPC analysis).

The error concealment 500 also comprises a pitch search 540, which is configured to obtain a pitch information 542, for example, on the basis of a previously decoded audio frame.

The error concealment 500 also comprises an extrapolation 550, which may be configured to obtain an extrapolated time domain excitation signal on the basis of the result of the LPC analysis (for example, on the basis of the time-domain excitation signal determined by the LPC analysis), and possibly on the basis of the result of the pitch search.

The error concealment 500 also comprises a noise generation 560, which provides a noise signal 562. The error concealment 500 also comprises a combiner/fader 570, which is configured to receive the extrapolated time-domain excitation signal 552 and the noise signal 562, and to provide, on the basis thereof, a combined time domain excitation signal 572. The combiner/fader 570 may be configured to combine the extrapolated time domain excitation signal 552 and the noise signal 562, wherein a fading may be performed, such that a relative contribution of the extrapolated time domain excitation signal 552 (which determines a deterministic component of the input signal of the LPC synthesis) decreases over time while a relative contribution of the noise signal 562 increases over time. However, a different functionality of the combiner/fader is also possible. Also, reference is made to the description below.

The error concealment 500 also comprises a LPC synthesis 580, which receives the combined time domain excitation signal 572 and which provides a time domain audio signal 582 on the basis thereof. For example, the LPC synthesis may also receive LPC filter coefficients describing a LPC shaping filter, which is applied to the combined time domain excitation signal 572, to derive the time domain audio signal 582. The LPC synthesis 580 may, for example, use LPC coefficients obtained on the basis of one or more previously decoded audio frames (for example, provided by the LPC analysis 530).

The error concealment 500 also comprises a de-emphasis 584, which may be considered as being optional. The de-emphasis 584 may provide a de-emphasized error concealment time domain audio signal 586.

The error concealment 500 also comprises, optionally, an overlap-and-add 590, which performs an overlap-and-add operation of time domain audio signals associated with subsequent frames (or sub-frames). However, it should be noted that the overlap-and-add 590 should be considered as optional, since the error concealment may also use a signal combination which is already provided in the audio decoder environment. For example, the overlap-and-add 590 may be replaced by the signal combination 390 in the audio decoder 300 in some embodiments.

In the following, some further details regarding the error concealment 500 will be described.

The error concealment 500 according to FIG. 5 covers the context of a transform domain codec as AAC_LC or AAC_ELD. Worded differently, the error concealment 500 is well-adapted for usage in such a transform domain codec (and, in particular, in such a transform domain audio decoder). In the case of a transform codec only (for example, in the absence of a linear-prediction-domain decoding path), an output signal from a last frame is used as a starting point. For example, a time domain audio signal 372 may be used as a starting point for the error concealment. No excitation signal is available, just an output time domain signal from (one or more) previous frames (like, for example, the time domain audio signal 372).

In the following, the sub-units and functionalities of the error concealment 500 will be described in more detail.

5.1. LPC Analysis

In the embodiment according to FIG. 5, all of the concealment is done in the excitation domain to get a smoother transition between consecutive frames. Therefore, it is necessitated first to find (or, more generally, obtain) a proper set of LPC parameters. In the embodiment according to FIG. 5, an LPC analysis 530 is done on the past pre-emphasized time domain signal 522. The LPC parameters (or LPC filter coefficients) are used to perform LPC analysis of the past synthesis signal (for example, on the basis of the time domain audio signal 510, or on the basis of the pre-emphasized time domain audio signal 522) to get an excitation signal (for example, a time domain excitation signal).

5.2. Pitch Search

There are different approaches to get the pitch to be used for building the new signal (for example, the error concealment audio information).

In the context of the codec using an LTP filter (long-term-prediction filter), like AAC-LTP, if the last frame was AAC with LTP, we use this last received LTP pitch lag and the corresponding gain for generating the harmonic part. In this case, the gain is used to decide whether to build harmonic part in the signal or not. For example, if the LTP gain is higher than 0.6 (or any other predetermined value), then the LTP information is used to build the harmonic part.

If there is not any pitch information available from the previous frame, then there are, for example, two solutions, which will be described in the following.

For example, it is possible to do a pitch search at the encoder and transmit in the bitstream the pitch lag and the gain. This is similar to the LTP, but there is not applied any filtering (also no LTP filtering in the clean channel).

Alternatively, it is possible to perform a pitch search in the decoder. The AMR-WB pitch search in case of TCX is done in the FFT domain. In ELD, for example, if the MDCT domain was used then the phases would be missed. Therefore, the pitch search is done directly in the excitation domain. This gives better results than doing the pitch search in the synthesis domain. The pitch search in the excitation domain is done first with an open loop by a normalized cross correlation. Then, optionally, we refine the pitch search by doing a closed loop search around the open loop pitch with a certain delta. Due to the ELD windowing limitations, a wrong pitch could be found, thus we also verify that the found pitch is correct or discard it otherwise.

To conclude, the pitch of the last properly decoded audio frame preceding the lost audio frame may be considered when providing the error concealment audio information. In some cases, there is a pitch information available from the decoding of the previous frame (i.e. the last frame preceding the lost audio frame). In this case, this pitch can be reused (possibly with some extrapolation and a consideration of a pitch change over time). We can also optionally reuse the pitch of more than one frame of the past to try to extrapolate the pitch that we need at the end of our concealed frame.

Also, if there is an information (for example, designated as long-term-prediction gain) available, which describes an intensity (or relative intensity) of a deterministic (for example, at least approximately periodic) signal component, this value can be used to decide whether a deterministic (or harmonic) component should be included into the error concealment audio information. In other words, by comparing said value (for example, LTP gain) with a predetermined threshold value, it can be decided whether a time domain excitation signal derived from a previously decoded audio frame should be considered for the provision of the error concealment audio information or not.

If there is no pitch information available from the previous frame (or, more precisely, from the decoding of the previous frame), there are different options. The pitch information could be transmitted from an audio encoder to an audio decoder, which would simplify the audio decoder but create a bitrate overhead. Alternatively, the pitch information can be determined in the audio decoder, for example, in the excitation domain, i.e. on the basis of a time domain excitation signal. For example, the time domain excitation signal derived from a previous, properly decoded audio frame can be evaluated to identify the pitch information to be used for the provision of the error concealment audio information.

5.3. Extrapolation of the Excitation or Creation of the Harmonic Part

The excitation (for example, the time domain excitation signal) obtained from the previous frame (either just computed for lost frame or saved already in the previous lost frame for multiple frame loss) is used to build the harmonic part (also designated as deterministic component or approximately periodic component) in the excitation (for example, in the input signal of the LPC synthesis) by copying the last pitch cycle as many times as needed to get one and a half of the frame. To save complexity we can also create one and an half frame only for the first loss frame and then shift the processing for subsequent frame loss by half a frame and create only one frame each. Then we have access to half a frame of overlap.

In case of the first lost frame after a good frame (i.e. a properly decoded frame), the first pitch cycle (for example, of the time domain excitation signal obtained on the basis of the last properly decoded audio frame preceding the lost audio frame) is low-pass filtered with a sampling rate dependent filter (since ELD covers a really broad sampling rate combination—going from AAC-ELD core to AAC-ELD with SBR or AAC-ELD dual rate SBR).

The pitch in a voice signal is almost changing at all times. Therefore, the concealment presented above tends to create some problems (or at least distortions) at the recovery because the pitch at end of the concealed signal (i.e. at the end of the error concealment audio information) often does not match the pitch of the first good frame. Therefore, optionally, in some embodiments it is tried to predict the pitch at the end of the concealed frame to match the pitch at the beginning of the recovery frame. For example, the pitch at the end of a lost frame (which is considered as a concealed frame) is predicted, wherein the target of the prediction is to set the pitch at the end of the lost frame (concealed frame) to approximate the pitch at the beginning of the first properly decoded frame following one or more lost frames (which first properly decoded frame is also called "recovery frame"). This could be done during the frame loss or during the first good frame (i.e. during the first properly received frame). To get even better results, it is possible to optionally reuse some conventional tools and adapt them, such as the Pitch Prediction and Pulse resynchronization. For details, reference is made, for example, to reference [6] and [7].

If a long-term-prediction (LTP) is used in a frequency domain codec, it is possible to use the lag as the starting information about the pitch. However, in some embodiments, it is also desired to have a better granularity to be able to better track the pitch contour. Therefore, it is advantageous to do a pitch search at the beginning and at the end of the last good (properly decoded) frame. To adapt the signal to the moving pitch, it is desirable to use a pulse resynchronization, which is present in the state of the art.

5.4. Gain of Pitch

In some embodiments, it is advantageous to apply a gain on the previously obtained excitation in order to reach the desired level. The "gain of the pitch" (for example, the gain of the deterministic component of the time domain excitation signal, i.e. the gain applied to a time domain excitation signal derived from a previously decoded audio frame, in order to obtain the input signal of the LPC synthesis), may, for example, be obtained by doing a normalized correlation in the time domain at the end of the last good (for example, properly decoded) frame. The length of the correlation may be equivalent to two sub-frames' length, or can be adaptively changed. The delay is equivalent to the pitch lag used for the creation of the harmonic part. We can also optionally perform the gain calculation only on the first lost frame and then only apply a fadeout (reduced gain) for the following consecutive frame loss.

The "gain of pitch" will determine the amount of tonality (or the amount of deterministic, at least approximately periodic signal components) that will be created. However, it is desirable to add some shaped noise to not have only an artificial tone. If we get very low gain of the pitch then we construct a signal that consists only of a shaped noise.

To conclude, in some cases the time domain excitation signal obtained, for example, on the basis of a previously decoded audio frame, is scaled in dependence on the gain (for example, to obtain the input signal for the LPC analysis). Accordingly, since the time domain excitation signal determines a deterministic (at least approximately periodic) signal component, the gain may determine a relative intensity of said deterministic (at least approximately periodic) signal components in the error concealment audio information. In addition, the error concealment audio information may be based on a noise, which is also shaped by the LPC synthesis, such that a total energy of the error concealment audio information is adapted, at least to some degree, to a properly decoded audio frame preceding the lost audio frame and, ideally, also to a properly decoded audio frame following the one or more lost audio frames.

5.5. Creation of the Noise Part

An "innovation" is created by a random noise generator. This noise is optionally further high pass filtered and optionally pre-emphasized for voiced and onset frames. As for the low pass of the harmonic part, this filter (for example, the high-pass filter) is sampling rate dependent. This noise (which is provided, for example, by a noise generation 560) will be shaped by the LPC (for example, by the LPC synthesis 580) to get as close to the background noise as possible. The high pass characteristic is also optionally changed over consecutive frame loss such that aver a certain amount a frame loss the is no filtering anymore to only get the full band shaped noise to get a comfort noise closed to the background noise.

An innovation gain (which may, for example, determine a gain of the noise 562 in the combination/fading 570, i.e. a gain using which the noise signal 562 is included into the input signal 572 of the LPC synthesis) is, for example, calculated by removing the previously computed contribution of the pitch (if it exists) (for example, a scaled version, scaled using the "gain of pitch", of the time domain excitation signal obtained on the basis of the last properly decoded audio frame preceding the lost audio frame) and doing a correlation at the end of the last good frame. As for the pitch gain, this could be done optionally only on the first lost frame and then fade out, but in this case the fade out could be either going to 0 that results to a completed muting or to an estimate noise level present in the background. The length of the correlation is, for example, equivalent to two sub-frames' length and the delay is equivalent to the pitch lag used for the creation of the harmonic part.

Optionally, this gain is also multiplied by (1-"gain of pitch") to apply as much gain on the noise to reach the energy missing if the gain of pitch is not one. Optionally, this gain is also multiplied by a factor of noise. This factor of noise is coming, for example, from the previous valid frame (for example, from the last properly decoded audio frame preceding the lost audio frame).

5.6. Fade Out

Fade out is mostly used for multiple frames loss. However, fade out may also be used in the case that only a single audio frame is lost.

In case of a multiple frame loss, the LPC parameters are not recalculated. Either, the last computed one is kept, or LPC concealment is done by converging to a background shape. In this case, the periodicity of the signal is converged to zero. For example, the time domain excitation signal 502 obtained on the basis of one or more audio frames preceding a lost audio frame is still using a gain which is gradually reduced over time while the noise signal 562 is kept constant or scaled with a gain which is gradually increasing over time, such that the relative weight of the time domain excitation signal 552 is reduced over time when compared to the relative weight of the noise signal 562. Consequently, the input signal 572 of the LPC synthesis 580 is getting more and more "noise-like". Consequently, the "periodicity" (or, more precisely, the deterministic, or at least approximately periodic component of the output signal 582 of the LPC synthesis 580) is reduced over time.

The speed of the convergence according to which the periodicity of the signal 572, and/or the periodicity of the signal 582, is converged to 0 is dependent on the parameters of the last correctly received (or properly decoded) frame and/or the number of consecutive erased frames, and is controlled by an attenuation factor, $\alpha$. The factor, $\alpha$, is further dependent on the stability of the LP filter. Optionally, it is possible to alter the factor $\alpha$ in ratio with the pitch length. If the pitch (for example, a period length associated with the pitch) is really long, then we keep α "normal", but if the pitch is really short, it is typically necessitated to copy a lot of times the same part of past excitation. This will quickly sound too artificial, and therefore it is advantageous to fade out faster this signal.

Further optionally, if available, we can take into account the pitch prediction output. If a pitch is predicted, it means that the pitch was already changing in the previous frame and then the more frames we loose the more far we are from the truth. Therefore, it is advantageous to speed up a bit the fade out of the tonal part in this case.

If the pitch prediction failed because the pitch is changing too much, it means that either the pitch values are not really reliable or that the signal is really unpredictable. Therefore, again, it is advantageous to fade out faster (for example, to fade out faster the time domain excitation signal 552 obtained on the basis of one or more properly decoded audio frames preceding the one or more lost audio frames).

5.7. LPC Synthesis

To come back to time domain, it is advantageous to perform a LPC synthesis 580 on the summation of the two excitations (tonal part and noisy part) followed by a de-emphasis.

Worded differently, it is advantageous to perform the LPC synthesis 580 on the basis of a weighted combination of a time domain excitation signal 552 obtained on the basis of one or more properly decoded audio frames preceding the lost audio frame (tonal part) and the noise signal 562 (noisy part). As mentioned above, the time domain excitation signal 552 may be modified when compared to the time domain excitation signal 532 obtained by the LPC analysis 530 (in addition to LPC coefficients describing a characteristic of the LPC synthesis filter used for the LPC synthesis 580). For example, the time domain excitation signal 552 may be a time scaled copy of the time domain excitation signal 532 obtained by the LPC analysis 530, wherein the time scaling may be used to adapt the pitch of the time domain excitation signal 552 to a desired pitch.

5.8. Overlap-and-Add

In the case of a transform codec only, to get the best overlap-add we create an artificial signal for half a frame more than the concealed frame and we create artificial aliasing on it. However, different overlap-add concepts may be applied.

In the context of regular AAC or TCX, an overlap-and-add is applied between the extra half frame coming from concealment and the first part of the first good frame (could be half or less for lower delay windows as AAC-LD).

In the special case of ELD (extra low delay), for the first lost frame, it is advantageous to run the analysis three times to get the proper contribution from the last three windows and then for the first concealment frame and all the following ones the analysis is run one more time. Then one ELD synthesis is done to be back in time domain with all the proper memory for the following frame in the MDCT domain.

To conclude, the input signal 572 of the LPC synthesis 580 (and/or the time domain excitation signal 552) may be provided for a temporal duration which is longer than a duration of a lost audio frame. Accordingly, the output signal 582 of the LPC synthesis 580 may also be provided for a time period which is longer than a lost audio frame. Accordingly, an overlap-and-add can be performed between the error concealment audio information (which is consequently obtained for a longer time period than a temporal extension of the lost audio frame) and a decoded audio information provided for a properly decoded audio frame following one or more lost audio frames.

To summarize, the error concealment 500 is well-adapted to the case in which the audio frames are encoded in the frequency domain. Even though the audio frames are encoded in the frequency domain, the provision of the error concealment audio information is performed on the basis of a time domain excitation signal. Different modifications are applied to the time domain excitation signal obtained on the basis of one or more properly decoded audio frames preceding a lost audio frame. For example, the time domain excitation signal provided by the LPC analysis 530 is adapted to pitch changes, for example, using a time scaling. Moreover, the time domain excitation signal provided by the LPC analysis 530 is also modified by a scaling (application of a gain), wherein a fade out of the deterministic (or tonal, or at least approximately periodic) component may be performed by the scaler/fader 570, such that the input signal 572 of the LPC synthesis 580 comprises both a component which is derived from the time domain excitation signal obtained by the LPC analysis and a noise component which is based on the noise signal 562. The deterministic component of the input signal 572 of the LPC synthesis 580 is, however, typically modified (for example, time scaled and/or amplitude scaled) with respect to the time domain excitation signal provided by the LPC analysis 530.

Thus, the time domain excitation signal can be adapted to the needs, and an unnatural hearing impression is avoided.

6. Time Domain Concealment According to FIG. 6

Figure 6:
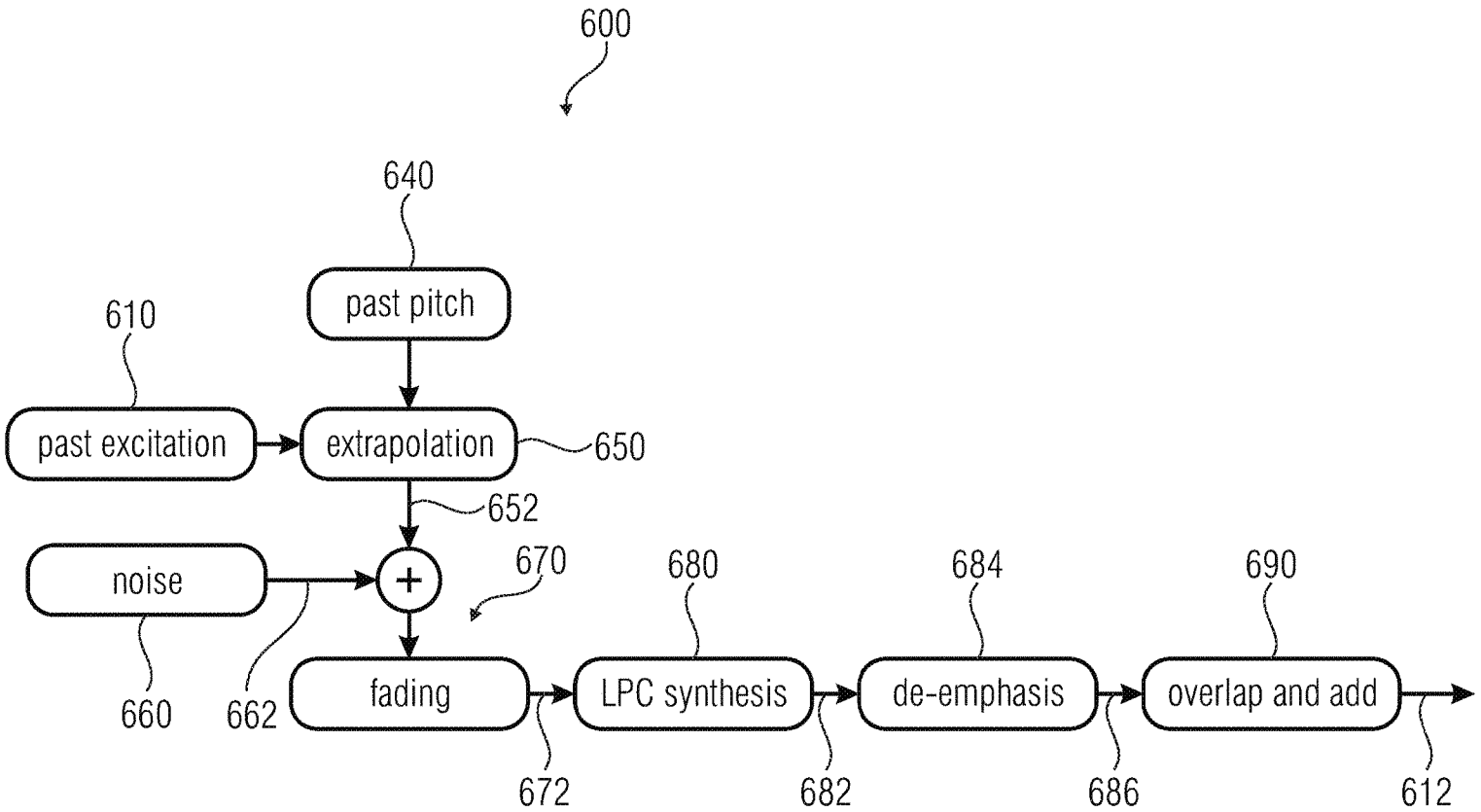
FIG. 6 shows a block schematic diagram of a time domain concealment for a switch codec.

FIG. 6 shows a block schematic diagram of a time domain concealment which can be used for a switch codec. For example, the time domain concealment 600 according to FIG. 6 may, for example, take the place of the error concealment 240 or the place of the error concealment 480.

Moreover, it should be noted that the embodiment according to FIG. 6 covers the context (may be used within the context) of a switch codec using time and frequency domain combined, such as USAC (MPEG-D/MPEG-H) or EVS (3GPP). In other words, the time domain concealment 600 may be used in audio decoders in which there is a switching between a frequency domain decoding and a time decoding (or, equivalently, a linear-prediction-coefficient based decoding).

However, it should be noted that the error concealment 600 according to FIG. 6 may also be used in audio decoders which merely perform a decoding in the time domain (or equivalently, in the linear-prediction-coefficient domain).

In the case of a switched codec (and even in the case of a codec merely performing the decoding in the linear-prediction-coefficient domain) we usually already have the excitation signal (for example, the time domain excitation signal) coming from a previous frame (for example, a properly decoded audio frame preceding a lost audio frame). Otherwise (for example, if the time domain excitation signal is not available), it is possible to do as explained in the embodiment according to FIG. 5, i.e. to perform an LPC analysis. If the previous frame was ACELP like, we also have already the pitch information of the sub-frames in the last frame. If the last frame was TCX (transform coded excitation) with LTP (long term prediction) we have also the lag information coming from the long term prediction. And if the last frame was in the frequency domain without long term prediction (LTP) then the pitch search is done directly in the excitation domain (for example, on the basis of a time domain excitation signal provided by an LPC analysis).

If the decoder is using already some LPC parameters in the time domain, we are reusing them and extrapolate a new set of LPC parameters. The extrapolation of the LPC parameters is based on the past LPC, for example the mean of the last three frames and (optionally) the LPC shape derived during the DTX noise estimation if DTX (discontinuous transmission) exists in the codec.

All of the concealment is done in the excitation domain to get smoother transition between consecutive frames.

In the following, the error concealment 600 according to FIG. 6 will be described in more detail.

The error concealment 600 receives a past excitation 610 and a past pitch information 640. Moreover, the error concealment 600 provides an error concealment audio information 612.

It should be noted that the past excitation 610 received by the error concealment 600 may, for example, correspond to the output 532 of the LPC analysis 530. Moreover, the past pitch information 640 may, for example, correspond to the output information 542 of the pitch search 540.

The error concealment 600 further comprises an extrapolation 650, which may correspond to the extrapolation 550, such that reference is made to the above discussion.

Moreover, the error concealment comprises a noise generator 660, which may correspond to the noise generator 560, such that reference is made to the above discussion.

The extrapolation 650 provides an extrapolated time domain excitation signal 652, which may correspond to the extrapolated time domain excitation signal 552. The noise generator 660 provides a noise signal 662, which corresponds to the noise signal 562.

The error concealment 600 also comprises a combiner/fader 670, which receives the extrapolated time domain excitation signal 652 and the noise signal 662 and provides, on the basis thereof, an input signal 672 for a LPC synthesis 680, wherein the LPC synthesis 680 may correspond to the LPC synthesis 580, such that the above explanations also apply. The LPC synthesis 680 provides a time domain audio signal 682, which may correspond to the time domain audio signal 582. The error concealment also comprises (optionally) a de-emphasis 684, which may correspond to the de-emphasis 584 and which provides a de-emphasized error concealment time domain audio signal 686. The error concealment 600 optionally comprises an overlap-and-add 690, which may correspond to the overlap-and-add 590. However, the above explanations with respect to the overlap-and-add 590 also apply to the overlap-and-add 690. In other words the overlap-and-add 690 may also be replaced by the audio decoder's overall overlap-and-add, such that the output signal 682 of the LPC synthesis or the output signal 686 of the de-emphasis may be considered as the error concealment audio information.

To conclude, the error concealment 600 substantially differs from the error concealment 500 in that the error concealment 600 directly obtains the past excitation information 610 and the past pitch information 640 directly from one or more previously decoded audio frames without the need to perform a LPC analysis and/or a pitch analysis. However, it should be noted that the error concealment 600 may, optionally, comprise a LPC analysis and/or a pitch analysis (pitch search).

In the following, some details of the error concealment 600 will be described in more detail. However, it should be noted that the specific details should be considered as examples, rather than as essential features.

6.1. Past Pitch of Pitch Search

There are different approaches to get the pitch to be used for building the new signal.

In the context of the codec using LTP filter, like AAC-LTP, if the last frame (preceding the lost frame) was AAC with LTP, we have the pitch information coming from the last LTP pitch lag and the corresponding gain. In this case we use the gain to decide if we want to build harmonic part in the signal or not. For example, if the LTP gain is higher than 0.6 then we use the LTP information to build harmonic part.

If we do not have any pitch information available from the previous frame, then there are, for example, two other solutions.

One solution is to do a pitch search at the encoder and transmit in the bitstream the pitch lag and the gain. This is similar to the long term prediction (LTP), but we are not applying any filtering (also no LTP filtering in the clean channel).

Another solution is to perform a pitch search in the decoder. The AMR-WB pitch search in case of TCX is done in the FFT domain. In TCX for example, we are using the MDCT domain, then we are missing the phases. Therefore, the pitch search is done directly in the excitation domain (for example, on the basis of the time domain excitation signal used as the input of the LPC synthesis, or used to derive the input for the LPC synthesis) in an embodiment. This typically gives better results than doing the pitch search in the synthesis domain (for example, on the basis of a fully decoded time domain audio signal).

The pitch search in the excitation domain (for example, on the basis of the time domain excitation signal) is done first with an open loop by a normalized cross correlation. Then, optionally, the pitch search can be refined by doing a closed loop search around the open loop pitch with a certain delta.

In implementations, we do not simply consider one maximum value of the correlation. If we have a pitch information from a non-error prone previous frame, then we select the pitch that correspond to one of the five highest values in the normalized cross correlation domain but the closest to the previous frame pitch. Then, it is also verified that the maximum found is not a wrong maximum due to the window limitation.

To conclude, there are different concepts to determine the pitch, wherein it is computationally efficient to consider a past pitch (i.e. pitch associated with a previously decoded audio frame). Alternatively, the pitch information may be transmitted from an audio encoder to an audio decoder. As another alternative, a pitch search can be performed at the side of the audio decoder, wherein the pitch determination is performed on the basis of the time domain excitation signal (i.e. in the excitation domain). A two stage pitch search comprising an open loop search and a closed loop search can be performed in order to obtain a particularly reliable and precise pitch information. Alternatively, or in addition, a pitch information from a previously decoded audio frame may be used in order to ensure that the pitch search provides a reliable result.

6.2. Extrapolation of the Excitation or Creation of the Harmonic Part

The excitation (for example, in the form of a time domain excitation signal) obtained from the previous frame (either just computed for lost frame or saved already in the previous lost frame for multiple frame loss) is used to build the harmonic part in the excitation (for example, the extrapolated time domain excitation signal 662) by copying the last pitch cycle (for example, a portion of the time domain excitation signal 610, a temporal duration of which is equal to a period duration of the pitch) as many times as needed to get, for example, one and a half of the (lost) frame.

To get even better results, it is optionally possible to reuse some tools known from state of the art and adapt them. For details, reference is made, for example, to reference [6] and [7].

It has been found that the pitch in a voice signal is almost changing at all times. It has been found that, therefore, the concealment presented above tends to create some problems at the recovery because the pitch at end of the concealed signal often doesn't match the pitch of the first good frame. Therefore, optionally, it is tried to predict the pitch at the end of the concealed frame to match the pitch at the beginning of the recovery frame. This functionality will be performed, for example, by the extrapolation 650.

If LTP in TCX is used, the lag can be used as the starting information about the pitch. However, it is desirable to have a better granularity to be able to track better the pitch contour. Therefore, a pitch search is optionally done at the beginning and at the end of the last good frame. To adapt the signal to the moving pitch, a pulse resynchronization, which is present in the state of the art, may be used.

To conclude, the extrapolation (for example, of the time domain excitation signal associated with, or obtained on the basis of, a last properly decoded audio frame preceding the lost frame) may comprise a copying of a time portion of said time domain excitation signal associated with a previous audio frame, wherein the copied time portion may be modified in dependence on a computation, or estimation, of an (expected) pitch change during the lost audio frame. Different concepts are available for determining the pitch change.

6.3. Gain of Pitch

In the embodiment according to FIG. 6, a gain is applied on the previously obtained excitation in order to reach a desired level. The gain of the pitch is obtained, for example, by doing a normalized correlation in the time domain at the end of the last good frame. For example, the length of the correlation may be equivalent to two sub-frames length and the delay may be equivalent to the pitch lag used for the creation of the harmonic part (for example, for copying the time domain excitation signal). It has been found that doing the gain calculation in time domain gives much more reliable gain than doing it in the excitation domain. The LPC are changing every frame and then applying a gain, calculated on the previous frame, on an excitation signal that will be processed by an other LPC set, will not give the expected energy in time domain.

The gain of the pitch determines the amount of tonality that will be created, but some shaped noise will also be added to not have only an artificial tone. If a very low gain of pitch is obtained, then a signal may be constructed that consists only of a shaped noise.

To conclude, a gain which is applied to scale the time domain excitation signal obtained on the basis of the previous frame (or a time domain excitation signal which is obtained for a previously decoded frame, or which is associated to the previously decoded frame) is adjusted to thereby determine a weighting of a tonal (or deterministic, or at least approximately periodic) component within the input signal of the LPC synthesis 680, and, consequently, within the error concealment audio information. Said gain can be determined on the basis of a correlation, which is applied to the time domain audio signal obtained by a decoding of the previously decoded frame (wherein said time domain audio signal may be obtained using a LPC synthesis which is performed in the course of the decoding).

6.4. Creation of the Noise Part

An innovation is created by a random noise generator 660. This noise is further high pass filtered and optionally pre-emphasized for voiced and onset frames. The high pass filtering and the pre-emphasis, which may be performed selectively for voiced and onset frames, are not shown explicitly in the FIG. 6, but may be performed, for example, within the noise generator 660 or within the combiner/fader 670.

The noise will be shaped (for example, after combination with the time domain excitation signal 652 obtained by the extrapolation 650) by the LPC to get as close as the background noise as possible.

For example, the innovation gain may be calculated by removing the previously computed contribution of the pitch (if it exists) and doing a correlation at the end of the last good frame. The length of the correlation may be equivalent to two sub-frames length and the delay may be equivalent to the pitch lag used for the creation of the harmonic part.

Optionally, this gain may also be multiplied by (1-gain of pitch) to apply as much gain on the noise to reach the energy missing if the gain of the pitch is not one. Optionally, this gain is also multiplied by a factor of noise. This factor of noise may be coming from a previous valid frame.

To conclude, a noise component of the error concealment audio information is obtained by shaping noise provided by the noise generator 660 using the LPC synthesis 680 (and, possibly, the de-emphasis 684). In addition, an additional high pass filtering and/or pre-emphasis may be applied. The gain of the noise contribution to the input signal 672 of the LPC synthesis 680 (also designated as "innovation gain") may be computed on the basis of the last properly decoded audio frame preceding the lost audio frame, wherein a deterministic (or at least approximately periodic) component may be removed from the audio frame preceding the lost audio frame, and wherein a correlation may then be performed to determine the intensity (or gain) of the noise component within the decoded time domain signal of the audio frame preceding the lost audio frame.

Optionally, some additional modifications may be applied to the gain of the noise component.

6.5. Fade Out

The fade out is mostly used for multiple frames loss. However, the fade out may also be used in the case that only a single audio frame is lost.

In case of multiple frame loss, the LPC parameters are not recalculated. Either the last computed one is kept or an LPC concealment is performed as explained above.

A periodicity of the signal is converged to zero. The speed of the convergence is dependent on the parameters of the last correctly received (or correctly decoded) frame and the number of consecutive erased (or lost) frames, and is controlled by an attenuation factor, $\alpha$. The factor, $\alpha$, is further dependent on the stability of the LP filter. Optionally, the factor $\alpha$ can be altered in ratio with the pitch length. For example, if the pitch is really long then $\alpha$ can be kept normal, but if the pitch is really short, it may be desirable (or necessitated) to copy a lot of times the same part of past excitation. Since it has been found that this will quickly sound too artificial, the signal is therefore faded out faster.

Furthermore optionally, it is possible to take into account the pitch prediction output. If a pitch is predicted, it means that the pitch was already changing in the previous frame and then the more frames are lost the more far we are from the truth. Therefore, it is desirable to speed up a bit the fade out of the tonal part in this case.

If the pitch prediction failed because the pitch is changing too much, this means either the pitch values are not really reliable or that the signal is really unpredictable. Therefore, again we should fade out faster.

To conclude, the contribution of the extrapolated time domain excitation signal 652 to the input signal 672 of the LPC synthesis 680 is typically reduced over time. This can be achieved, for example, by reducing a gain value, which is applied to the extrapolated time domain excitation signal 652, over time. The speed used to gradually reduce the gain applied to scale the time domain excitation signal 552 obtained on the basis of one or more audio frames preceding a lost audio frame (or one or more copies thereof) is adjusted in dependence on one or more parameters of the one or more audio frames (and/or in dependence on a number of consecutive lost audio frames). In particular, the pitch length and/or the rate at which the pitch changes over time, and/or the question whether a pitch prediction fails or succeeds, can be used to adjust said speed.

6.6. LPC Synthesis

To come back to time domain, an LPC synthesis 680 is performed on the summation (or generally, weighted combination) of the two excitations (tonal part 652 and noisy part 662) followed by the de-emphasis 684.

In other words, the result of the weighted (fading) combination of the extrapolated time domain excitation signal 652 and the noise signal 662 forms a combined time domain excitation signal and is input into the LPC synthesis 680, which may, for example, perform a synthesis filtering on the basis of said combined time domain excitation signal 672 in dependence on LPC coefficients describing the synthesis filter.

6.7. Overlap-and-Add

Since it is not known during concealment what will be the mode of the next frame coming (for example, ACELP, TCX or FD), it is advantageous to prepare different overlaps in advance. To get the best overlap-and-add if the next frame is in a transform domain (TCX or FD) an artificial signal (for example, an error concealment audio information) may, for example, be created for half a frame more than the concealed (lost) frame. Moreover, artificial aliasing may be created on it (wherein the artificial aliasing may, for example, be adapted to the MDCT overlap-and-add).

To get a good overlap-and-add and no discontinuity with the future frame in time domain (ACELP), we do as above but without aliasing, to be able to apply long overlap add windows or if we want to use a square window, the zero input response (ZIR) is computed at the end of the synthesis buffer.

To conclude, in a switching audio decoder (which may, for example, switch between an ACELP decoding, a TCX decoding and a frequency domain decoding (FD decoding)), an overlap-and-add may be performed between the error concealment audio information which is provided primarily for a lost audio frame, but also for a certain time portion following the lost audio frame, and the decoded audio information provided for the first properly decoded audio frame following a sequence of one or more lost audio frames. In order to obtain a proper overlap-and-add even for decoding modes which bring along a time domain aliasing at a transition between subsequent audio frames, an aliasing cancellation information (for example, designated as artificial aliasing) may be provided. Accordingly, an overlap-and-add between the error concealment audio information and the time domain audio information obtained on the basis of the first properly decoded audio frame following a lost audio frame, results in a cancellation of aliasing.

If the first properly decoded audio frame following the sequence of one or more lost audio frames is encoded in the ACELP mode, a specific overlap information may be computed, which may be based on a zero input response (ZIR) of a LPC filter.

To conclude, the error concealment 600 is well suited to usage in a switching audio codec. However, the error concealment 600 can also be used in an audio codec which merely decodes an audio content encoded in a TCX mode or in an ACELP mode.

6.8. Conclusion

It should be noted that a particularly good error concealment is achieved by the above mentioned concept to extrapolate a time domain excitation signal, to combine the result of the extrapolation with a noise signal using a fading (for example, a cross-fading) and to perform an LPC synthesis on the basis of a result of a cross-fading.

7. Audio Decoder According to FIG. 11

Figure 11:
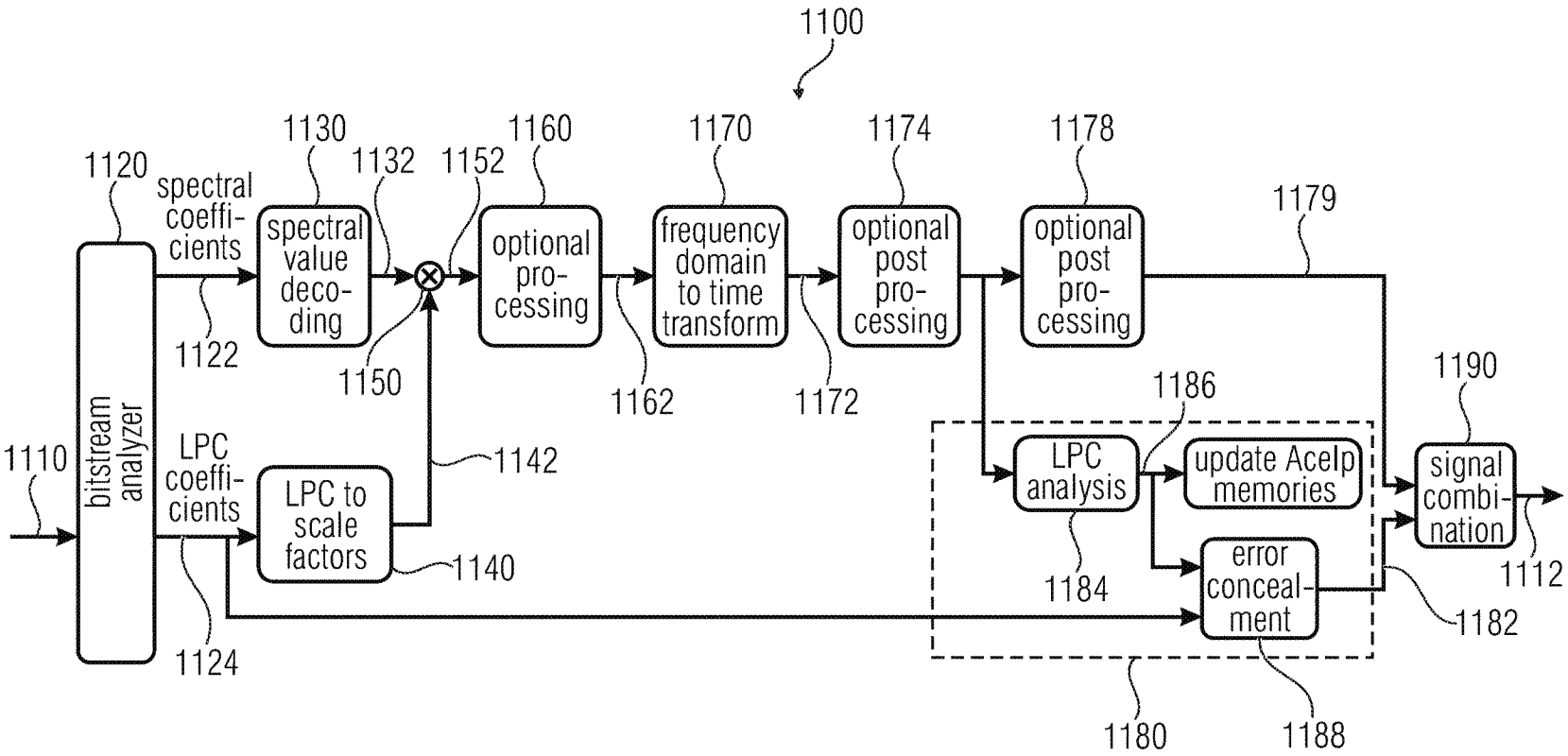
FIG. 11 shows a block schematic diagram of an audio decoder, according to another embodiment of the present invention.

FIG. 11 shows a block schematic diagram of an audio decoder 1100, according to an embodiment of the present invention.

It should be noted that the audio decoder 1100 can be a part of a switching audio decoder. For example, the audio decoder 1100 may replace the linear-prediction-domain decoding path 440 in the audio decoder 400.

The audio decoder 1100 is configured to receive an encoded audio information 1110 and to provide, on the basis thereof, a decoded audio information 1112. The encoded audio information 1110 may, for example, correspond to the encoded audio information 410 and the decoded audio information 1112 may, for example, correspond to the decoded audio information 412.

The audio decoder 1100 comprises a bitstream analyzer 1120, which is configured to extract an encoded representation 1122 of a set of spectral coefficients and an encoded representation of linear-prediction coding coefficients 1124 from the encoded audio information 1110. However, the bitstream analyzer 1120 may optionally extract additional information from the encoded audio information 1110.

The audio decoder 1100 also comprises a spectral value decoding 1130, which is configured to provide a set of decoded spectral values 1132 on the basis of the encoded spectral coefficients 1122. Any decoding concept known for decoding spectral coefficients may be used.

The audio decoder 1100 also comprises a linear-prediction-coding coefficient to scale-factor conversion 1140 which is configured to provide a set of scale factors 1142 on the basis of the encoded representation 1124 of linear-prediction-coding coefficients. For example, the linear-prediction-coding-coefficient to scale-factor conversion 1142 may perform a functionality which is described in the USAC standard. For example, the encoded representation 1124 of the linear-prediction-coding coefficients may comprise a polynomial representation, which is decoded and converted into a set of scale factors by the linear-prediction-coding coefficient to scale-factor-conversion 1142.

The audio decoder 1100 also comprises a scalar 1150, which is configured to apply the scale factors 1142 to the decoded spectral values 1132, to thereby obtain scaled decoded spectral values 1152. Moreover, the audio decoder 1100 comprises, optionally, a processing 1160, which may, for example, correspond to the processing 366 described above, wherein processed scaled decoded spectral values 1162 are obtained by the optional processing 1160. The audio decoder 1100 also comprises a frequency-domain-to-time-domain transform 1170, which is configured to receive the scaled decoded spectral values 1152 (which may correspond to the scaled decoded spectral values 362), or the processed scaled decoded spectral values 1162 (which may correspond to the processed scaled decoded spectral values 368) and provide, on the basis thereof, a time domain representation 1172, which may correspond to the time domain representation 372 described above. The audio decoder 1100 also comprises an optional first post-processing 1174, and an optional second post-processing 1178, which may, for example, correspond, at least partly, to the optional post-processing 376 mentioned above. Accordingly, the audio decoder 1110 obtains (optionally) a post-processed version 1179 of the time domain audio representation 1172.

The audio decoder 1100 also comprises an error concealment block 1180 which is configured to receive the time domain audio representation 1172, or a post-processed version thereof, and the linear-prediction-coding coefficients (either in encoded form, or in a decoded form) and provides, on the basis thereof, an error concealment audio information 1182.

The error concealment block 1180 is configured to provide the error concealment audio information 1182 for concealing a loss of an audio frame following an audio frame encoded in a frequency domain representation using a time domain excitation signal, and therefore is similar to the error concealment 380 and to the error concealment 480, and also to the error concealment 500 and to the error concealment 600.

However, the error concealment block 1180 comprises an LPC analysis 1184, which is substantially identical to the LPC analysis 530. However, the LPC analysis 1184 may, optionally, use the LPC coefficients 1124 to facilitate the analysis (when compared to the LPC analysis 530). The LPC analysis 1134 provides a time domain excitation signal 1186, which is substantially identical to the time domain excitation signal 532 (and also to the time domain excitation signal 610). Moreover, the error concealment block 1180 comprises an error concealment 1188, which may, for example, perform the functionality of blocks 540, 550, 560, 570, 580, 584 of the error concealment 500, or which may, for example, perform the functionality of blocks 640, 650, 660, 670, 680, 684 of the error concealment 600. However, the error concealment block 1180 slightly differs from the error concealment 500 and also from the error concealment 600. For example, the error concealment block 1180 (comprising the LPC analysis 1184) differs from the error concealment 500 in that the LPC coefficients (used for the LPC synthesis 580) are not determined by the LPC analysis 530, but are (optionally) received from the bitstream. Moreover, the error concealment block 1188, comprising the LPC analysis 1184, differs from the error concealment 600 in that the "past excitation" 610 is obtained by the LPC analysis 1184, rather than being available directly.

The audio decoder 1100 also comprises a signal combination 1190, which is configured to receive the time domain audio representation 1172, or a post-processed version thereof, and also the error concealment audio information 1182 (naturally, for subsequent audio frames) and combines said signals, using an overlap-and-add operation, to thereby obtain the decoded audio information 1112.

For further details, reference is made to the above explanations.

8. Method According to FIG. 9

Figure 9:
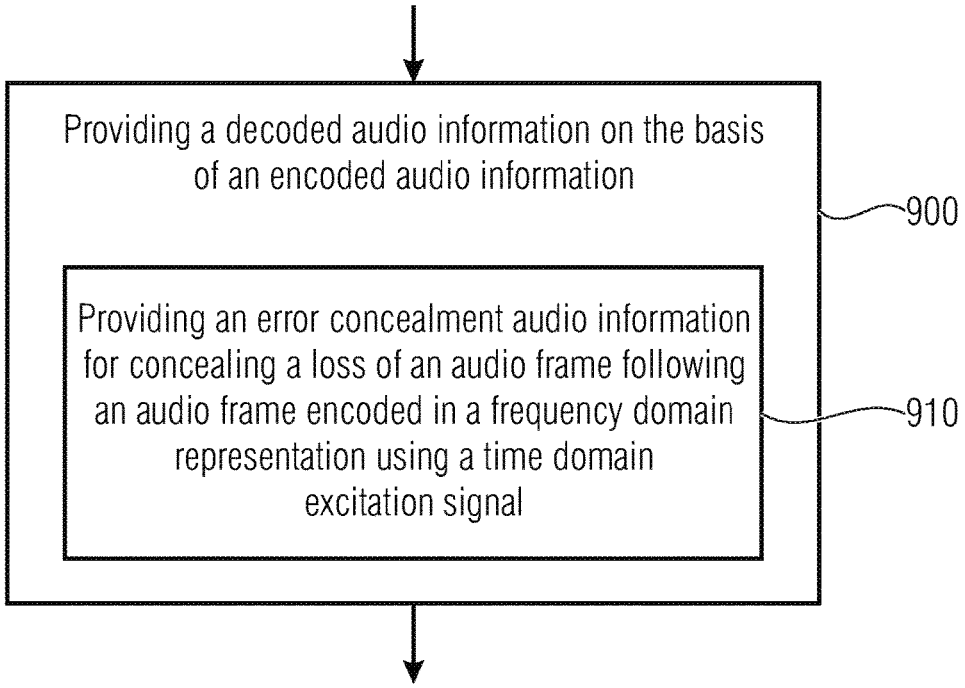
FIG. 9 shows a flowchart of a method for providing a decoded audio information on the basis of an encoded audio information, according to an embodiment of the present invention.

FIG. 9 shows a flowchart of a method for providing a decoded audio information on the basis of an encoded audio information. The method 900 according to FIG. 9 comprises providing 910 an error concealment audio information for concealing a loss of an audio frame following an audio frame encoded in a frequency domain representation using a time domain excitation signal. The method 900 according to FIG. 9 is based on the same considerations as the audio decoder according to FIG. 1. Moreover, it should be noted that the method 900 can be supplemented by any of the features and functionalities described herein, either individually or in combination.

9. Method According to FIG. 10

Figure 10:
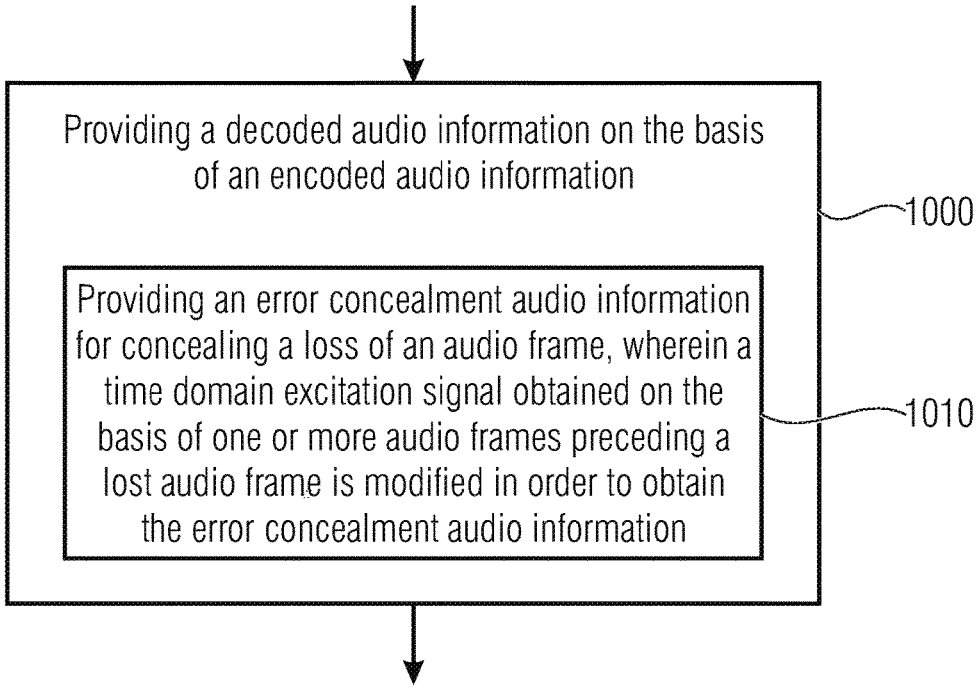
FIG. 10 shows a flowchart of a method for providing a decoded audio information on the basis of an encoded audio information, according to another embodiment of the present invention.

FIG. 10 shows a flow chart of a method for providing a decoded audio information on the basis of an encoded audio information. The method 1000 comprises providing 1010 an error concealment audio information for concealing a loss of an audio frame, wherein a time domain excitation signal obtained for (or on the basis of) one or more audio frames preceding a lost audio frame is modified in order to obtain the error concealment audio information.

The method 1000 according to FIG. 10 is based on the same considerations as the above mentioned audio decoder according to FIG. 2.

Moreover, it should be noted that the method according to FIG. 10 can be supplemented by any of the features and functionalities described herein, either individually or in combination.

10. Additional Remarks

In the above described embodiments, multiple frame loss can be handled in different ways. For example, if two or more frames are lost, the periodic part of the time domain excitation signal for the second lost frame can be derived from (or be equal to) a copy of the tonal part of the time domain excitation signal associated with the first lost frame. Alternatively, the time domain excitation signal for the second lost frame can be based on an LPC analysis of the synthesis signal of the previous lost frame. For example in a codec the LPC may be changing every lost frame, then it makes sense to redo the analysis for every lost frame.

11. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

12. Conclusions

To conclude, while some concealment for transform domain codecs has been described in the field, embodiments according to the invention outperform conventional codecs (or decoders). Embodiments according to the invention use a change of domain for concealment (frequency domain to time or excitation domain). Accordingly, embodiments according to the invention create a high quality speech concealment for transform domain decoders.

The transform coding mode is similar to the one in USAC (confer, for example, reference [3]). It uses the modified discrete cosine transform (MDCT) as a transform and the spectral noise shaping is achieved by applying the weighted LPC spectral envelope in the frequency domain (also known as FDNS "frequency domain noise shaping"). Worded differently, embodiments according to the invention can be used in an audio decoder, which uses the decoding concepts described in the USAC standard. However, the error concealment concept disclosed herein can also be used in an audio decoder which his "AAC" like or in any AAC family codec (or decoder).

The concept according to the present invention applies to a switched codec such as USAC as well as to a pure frequency domain codec. In both cases, the concealment is performed in the time domain or in the excitation domain.

In the following, some advantages and features of the time domain concealment (or of the excitation domain concealment) will be described.

Figure 7A:
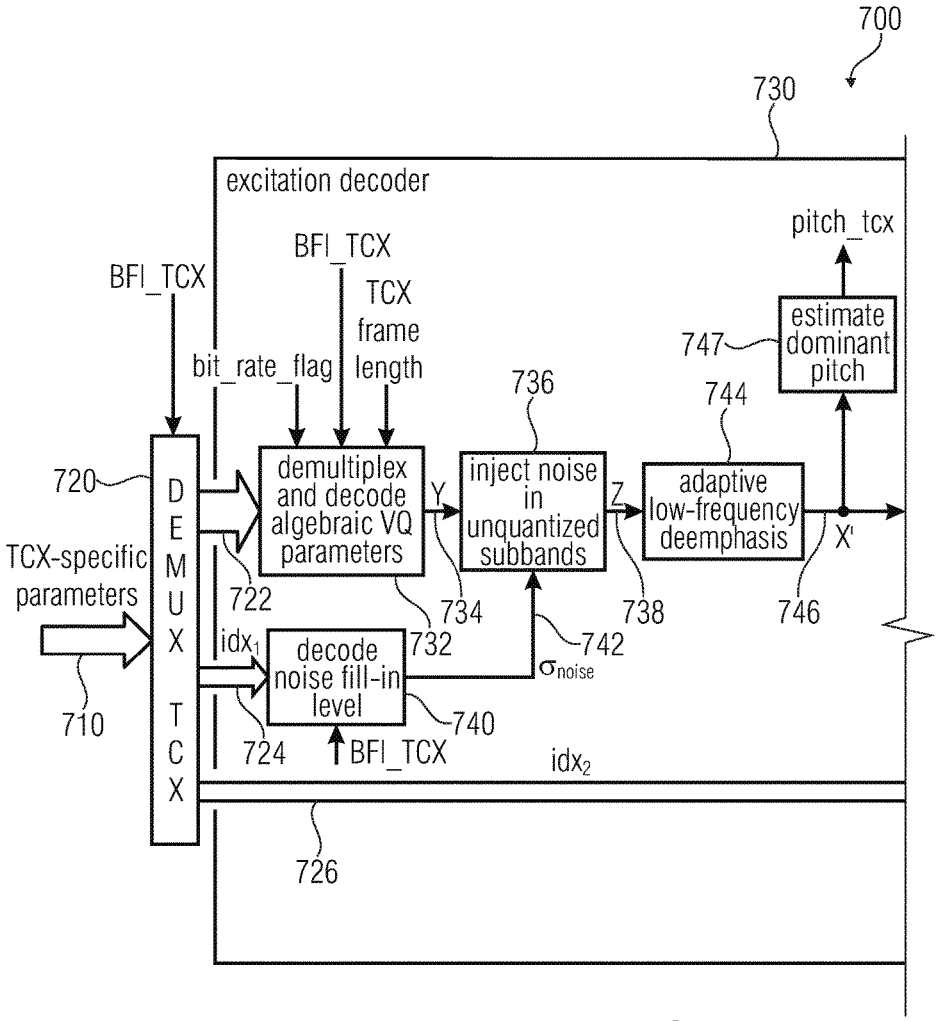
FIG. 7 shown in FIGS. 7A and 7B, shows a block diagram of a TCX decoder performing a TCX decoding in normal operation or in case of partial packet loss.
Figure 7B:
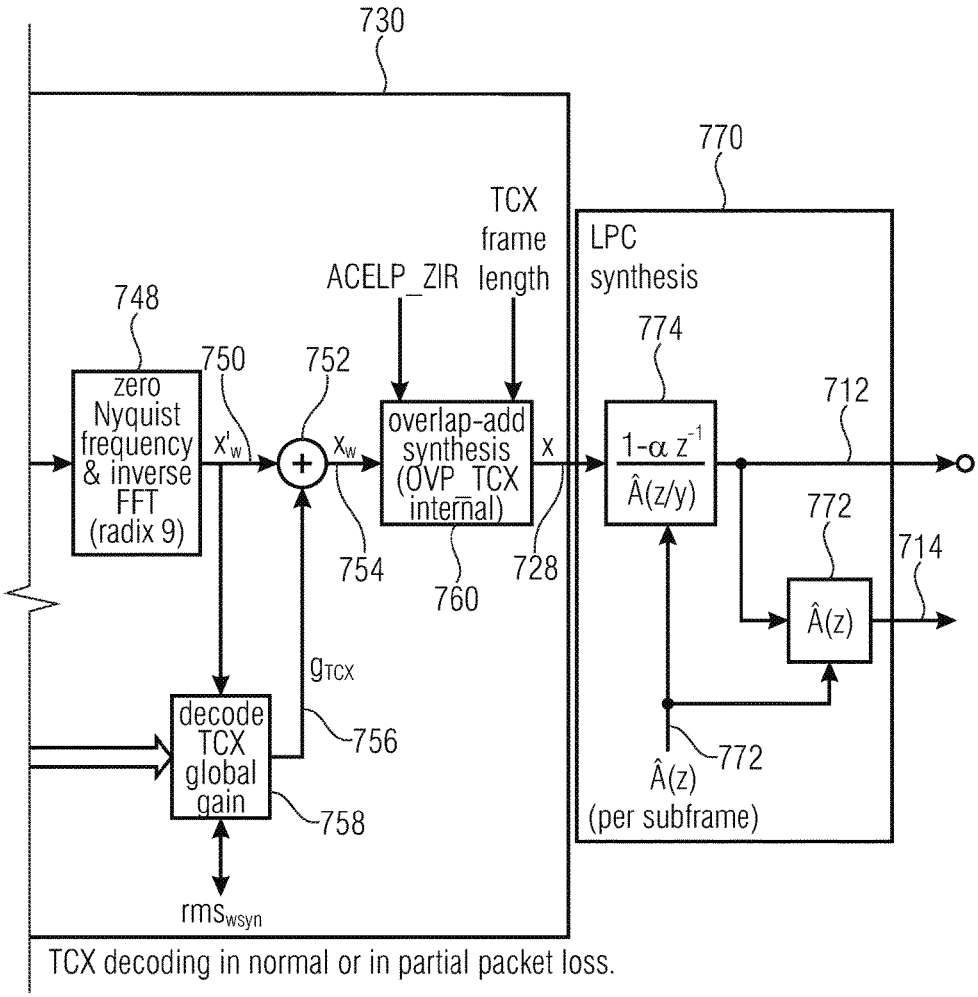
Figure 8:
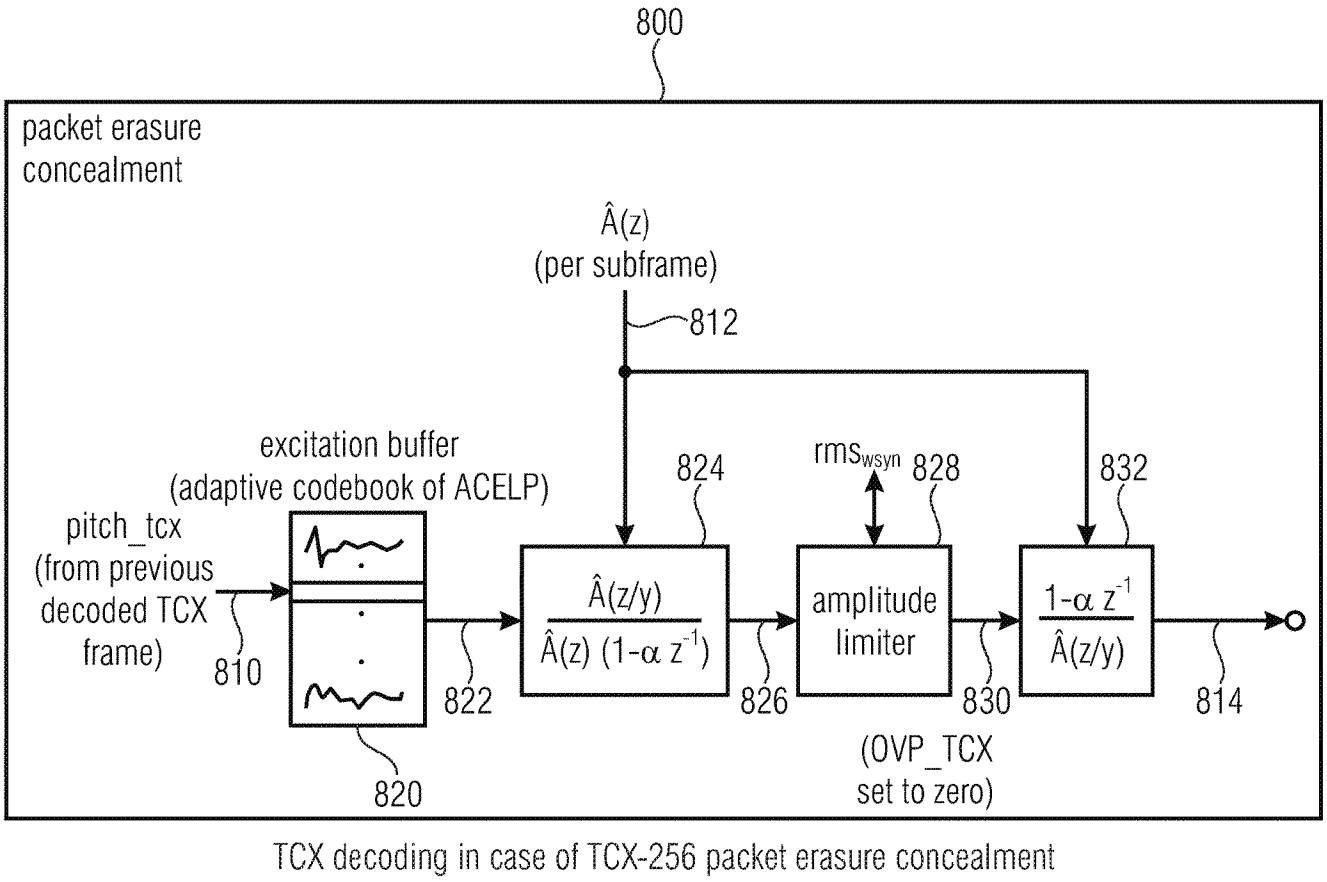
FIG. 8 shows a block schematic diagram of a TCX decoder performing a TCX decoding in case of TCX-256 packet erasure concealment.

Conventional TCX concealment, as described, for example, taking reference to FIGS. 7 and 8, also called noise substitution, is not well suited for speech-like signals or even tonal signals. Embodiments according to the invention create a new concealment for a transform domain codec that is applied in the time domain (or excitation domain of a linear-prediction-coding decoder). It is similar to an ACELP-like concealment and increases the concealment quality. It has been found that the pitch information is advantageous (or even necessitated, in some cases) for an ACELP-like concealment. Thus, embodiments according to the present invention are configured to find reliable pitch values for the previous frame coded in the frequency domain.

Different parts and details have been explained above, for example based on the embodiments according to FIGS. 5 and 6.

To conclude, embodiments according to the invention create an error concealment which outperforms the conventional solutions.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

BIBLIOGRAPHY

[1] 3GPP, "Audio codec processing functions; Extended Adaptive Multi-Rate—Wideband (AMR-WB+) codec; Transcoding functions," 2009, 3GPP TS 26.290.

[2] "MDCT-BASED CODER FOR HIGHLY ADAPTIVE SPEECH AND AUDIO CODING"; Guillaume Fuchs & al.; EUSIPCO 2009.

[3] ISO_IEC_DIS_23003-3 (E); Information technology—MPEG audio technologies—Part 3: Unified speech and audio coding.

[4] 3GPP, "General Audio Codec audio processing functions; Enhanced aacPlus general audio codec; Additional decoder tools," 2009, 3GPP TS 26.402.

[5] "Audio decoder and coding error compensating method", 2000, EP 1207519 B1

[6] "Apparatus and method for improved concealment of the adaptive codebook in ACELP-like concealment employing improved pitch lag estimation", 2014, PCT/EP2014/062589

[7] "Apparatus and method for improved concealment of the adaptive codebook in ACELP-like concealment employing improved pulse resynchronization", 2014, PCT/EP2014/062578

What is claimed is:

1. An audio decoder for providing a decoded audio information on the basis of an encoded audio information, the audio decoder comprising:

an error concealment unit configured to provide an error concealment audio information for concealing a loss of an audio frame following an audio frame encoded in a frequency domain representation using a time domain excitation signal;

wherein the audio decoder comprises a frequency-domain decoder core configured to apply a scale-factor-based scaling to a plurality of spectral values derived from the frequency-domain representation, and wherein the error concealment unit is configured to provide the error concealment audio information for concealing a loss of an audio frame following an audio frame encoded in a frequency domain representation comprising a plurality of encoded scale factors using a time domain excitation signal derived from the frequency domain representation;

wherein the error concealment unit is configured to acquire the time domain excitation signal on the basis of the audio frame encoded in the frequency domain representation preceding a lost audio frame.

2. The audio decoder according to claim 1, wherein the error concealment unit is configured to derive the error concealment audio information on the basis of at least three partially overlapping frames or windows preceding a lost audio frame or a lost window.

3. The audio decoder according to claim 1, wherein the audio decoder comprises a frequency-domain decoder core configured to derive a time domain audio signal representation from the frequency-domain representation without using a time domain excitation signal as an intermediate quantity for the audio frame encoded in the frequency domain representation.

4. The audio decoder according to claim 1, wherein the error concealment unit is configured to acquire the time domain excitation signal on the basis of the audio frame encoded in the frequency domain representation preceding a lost audio frame, and wherein the error concealment unit is configured to provide the error concealment audio information for concealing the lost audio frame using said time domain excitation signal.

5. The audio decoder according to claim 1, wherein the error concealment unit is configured to perform an LPC analysis on the basis of the audio frame encoded in the frequency domain representation preceding the lost audio frame, to acquire a set of linear-prediction-coding parameters and the time-domain excitation signal representing an audio content of the audio frame encoded in the frequency domain representation preceding the lost audio frame; or wherein the error concealment unit is configured to perform an LPC analysis on the basis of the audio frame encoded in the frequency domain representation preceding the lost audio frame, to acquire the time-domain excitation signal representing an audio content of the audio frame encoded in the frequency domain representation preceding the lost audio frame; or wherein the audio decoder is configured to acquire a set of linear-prediction-coding parameters using a linear-prediction-coding parameter estimation; or wherein the audio decoder is configured to acquire a set of linear-prediction-coding parameters on the basis of a set of scale factors using a transform.

6. The audio decoder according to claim 1, wherein the error concealment unit is configured to acquire a pitch information describing a pitch of the audio frame encoded in the frequency domain representation preceding the lost audio frame, and to provide the error concealment audio information in dependence on the pitch information.

7. The audio decoder according to claim 6, wherein the error concealment unit is configured to acquire the pitch information on the basis of the time domain excitation signal derived from the audio frame encoded in the frequency domain representation preceding the lost audio frame.

8. The audio decoder according to claim 7, wherein the error concealment unit is configured to evaluate a cross correlation of the time domain excitation signal or the time domain signal, to determine a coarse pitch information, and wherein the error concealment unit is configured to refine the coarse pitch information using a closed loop search around a pitch determined by the coarse pitch information.

9. The audio decoder according to claim 1, wherein the error concealment unit is configured to acquire a pitch information on the basis of a side information of the encoded audio information.

10. The audio decoder according to claim 1, wherein the error concealment unit is configured to acquire a pitch information on the basis of a pitch information available for a previously decoded audio frame.

11. The audio decoder according to claim 1, wherein the error concealment unit is configured to acquire a pitch information on the basis of a pitch search performed on a time domain signal or on a residual signal.

12. The audio decoder according to claim 1, wherein the error concealment unit is configured to copy a pitch cycle of the time domain excitation signal derived from the audio frame encoded in the frequency domain representation preceding the lost audio frame one time or multiple times, in order to acquire a excitation signal for a synthesis of the error concealment audio information.

13. The audio decoder according to claim 12, wherein the error concealment unit is configured to low-pass filter the pitch cycle of the time domain excitation signal derived from the time domain representation of the audio frame encoded in the frequency domain representation preceding the lost audio frame using a sampling-rate dependent filter, a bandwidth of which is dependent on a sampling rate of the audio frame encoded in a frequency domain representation.

14. The audio decoder according to claim 12, wherein the error concealment unit is configured to change the spectral shape of a noise signal using a pre-emphasis filter wherein the noise signal is combined with the extrapolated time domain excitation signal if the audio frame encoded in a frequency domain representation preceding the lost audio frame is a voiced audio frame or comprises an onset.

15. The audio decoder according to claim 1, wherein the error concealment unit is configured to combine an extrapolated time domain excitation signal and a noise signal, in order to acquire an input signal for an LPC synthesis, and wherein the error concealment unit is configured to perform the LPC synthesis, wherein the LPC synthesis is configured to filter the input signal of the LPC synthesis in dependence on linear-prediction-coding parameters, in order to acquire the error concealment audio information.

16. The audio decoder according to claim 15, wherein the error concealment unit is configured to compute a gain of the extrapolated time domain excitation signal, which is used to acquire the input signal for the LPC synthesis, using a correlation in the time domain which is performed on the basis of a time domain representation of the audio frame encoded in the frequency domain representation preceding the lost audio frame, wherein a correlation lag is set in dependence on a pitch information acquired on the basis of the time-domain excitation signal, or using a correlation in the excitation domain.

17. The audio decoder according to claim 15, wherein the error concealment unit is configured to high-pass filter the noise signal which is combined with the extrapolated time domain excitation signal.

18. The audio decoder according to claim 1, wherein the error concealment unit is configured to predict a pitch at the end of a lost frame, and wherein the error concealment unit is configured to adapt the time domain excitation signal, or one or more copies thereof, to the predicted pitch, in order to acquire an input signal for an LPC synthesis.

19. The audio decoder according to claim 1, wherein the error concealment unit is configured to compute a gain of the noise signal in dependence on a correlation in the time domain which is performed on the basis of a time domain representation of the audio frame encoded in the frequency domain representation preceding the lost audio frame.

20. The audio decoder according to claim 1, wherein the error concealment unit is configured to modify a time domain excitation signal acquired on the basis of one or more audio frames preceding a lost audio frame, in order to acquire the error concealment audio information.

21. The audio decoder according to claim 20, wherein the error concealment unit is configured to use one or more modified copies of the time domain excitation signal acquired on the basis of one or more audio frames preceding a lost audio frame, in order to acquire the error concealment information.

22. The audio decoder according to claim 20, wherein the error concealment unit is configured to modify the time domain excitation signal acquired on the basis of one or more audio frames preceding a lost audio frame, or one or more copies thereof, to thereby reduce a periodic component of the error concealment audio information over time.

23. The audio decoder according to claim 22, wherein the error concealment unit is configured to gradually reduce a gain applied to scale the time domain excitation signal acquired on the basis of one or more audio frames preceding a lost audio frame, or the one or more copies thereof.

24. The audio decoder according to claim 23, wherein the error concealment unit is configured to adjust the speed used to gradually reduce a gain applied to scale the time domain excitation signal acquired on the basis of one or more audio frames preceding a lost audio frame, or the one or more copies thereof, in dependence on a length of a pitch period of the time domain excitation signal, such that a time domain excitation signal input into an LPC synthesis is faded out faster for signals having a shorter length of the pitch period when compared to signals having a larger length of the pitch period.

25. The audio decoder according to claim 23 wherein the error concealment unit is configured to adjust the speed used to gradually reduce a gain applied to scale the time domain excitation signal acquired on the basis of one or more audio frames preceding a lost audio frame, or the one or more copies thereof, in dependence on a result of a pitch analysis or a pitch prediction, such that a deterministic component of a time domain excitation signal input into an LPC synthesis is faded out faster for signals having a larger pitch change per time unit when compared to signals having a smaller pitch change per time unit, and/or such that a deterministic component of a time domain excitation signal input into an LPC synthesis is faded out faster for signals for which a pitch prediction fails when compared to signals for which the pitch prediction succeeds.

26. The audio decoder according to claim 22, wherein the error concealment unit is configured to adjust a speed used to gradually reduce a gain applied to scale the time domain excitation signal acquired on the basis of one or more audio frames preceding a lost audio frame, or the one or more copies thereof, in dependence on one or more parameters of one or more audio frames preceding the lost audio frame, and/or in dependence on a number of consecutive lost audio frames.

27. The audio decoder according to claim 20, wherein the error concealment unit is configured to scale the time domain excitation signal acquired on the basis of one or more audio frames preceding the lost audio frame, or one or more copies thereof, to thereby modify the time domain excitation signal.

28. The audio decoder according to claim 20, wherein the error concealment unit is configured to time-scale the time domain excitation signal acquired on the basis of one or more audio frames preceding a lost audio frame, or the one or more copies thereof, in dependence on a prediction of a pitch for the time of the one or more lost audio frames.

29. The audio decoder according to claim 1, wherein the error concealment unit is configured to provide the error concealment audio information for a time which is longer than a temporal duration of the one or more lost audio frames.

30. The audio decoder according to claim 29, wherein the error concealment unit is configured to perform an overlap-and-add of the error concealment audio information and a time domain representation of one or more properly received audio frames following the one or more lost audio frames.

31. A method for providing a decoded audio information on the basis of an encoded audio information, the method comprising:

providing an error concealment audio information for concealing a loss of an audio frame following an audio frame encoded in a frequency domain representation using a time domain excitation signal; and applying a scale-factor-based scaling to a plurality of spectral values derived from the frequency-domain representation;

wherein the error concealment audio information for concealing a loss of an audio frame following an audio frame encoded in a frequency domain representation comprising a plurality of encoded scale factors is provided using a time domain excitation signal derived from the frequency domain representation;

wherein the time domain excitation signal is acquired on the basis of the audio frame encoded in the frequency domain representation preceding a lost audio frame.

32. A non-transitory digital storage medium having a computer program stored thereon to perform the method according to claim 31 when said computer program is run by a computer.

* * * * *